US012320560B2

(12) United States Patent
Yang et al.

(10) Patent No.: US 12,320,560 B2
(45) Date of Patent: Jun. 3, 2025

(54) CARBON DIOXIDE REFRIGERATING SYSTEM AND REFRIGERATING METHOD THEREOF

(71) Applicant: JINGKELUN REFRIGERATION EQUIPMENT CO., LTD., Beijing (CN)

(72) Inventors: Jianguo Yang, Beijing (CN); Chengjun Zhou, Beijing (CN); Jianhui Kang, Beijing (CN); Weibo Xie, Beijing (CN); Shiheng Yang, Beijing (CN); Chuangzi Shen, Beijing (CN); Xiaobing Sheng, Beijing (CN); Wenjie Cao, Beijing (CN)

(73) Assignee: JINGKELUN REFRIGERATION EQUIPMENT CO., LTD., Beijing (CN)

( * ) Notice: Subject to any disclaimer, the term of this patent is extended or adjusted under 35 U.S.C. 154(b) by 737 days.

(21) Appl. No.: 17/606,437

(22) PCT Filed: Apr. 16, 2020

(86) PCT No.: PCT/CN2020/085061
§ 371 (c)(1),
(2) Date: Oct. 25, 2021

(87) PCT Pub. No.: WO2021/012725
PCT Pub. Date: Jan. 28, 2021

(65) Prior Publication Data

US 2022/0316779 A1 Oct. 6, 2022

(30) Foreign Application Priority Data

Jul. 22, 2019 (CN) ..... 201921160257.8
Nov. 15, 2019 (CN) ..... 201911122549.7

(51) Int. Cl.
*F25B 41/20* (2021.01)
*F25B 9/00* (2006.01)
(Continued)

(52) U.S. Cl.
CPC ..... *F25B 41/20* (2021.01); *F25B 9/008* (2013.01); *F25B 41/39* (2021.01); *F28D 5/02* (2013.01); *F25B 2400/23* (2013.01)

(58) Field of Classification Search
None
See application file for complete search history.

(56) References Cited

U.S. PATENT DOCUMENTS 7,128,310 B2 * 10/2006 Mockry ..... F28F 25/00 165/DIG. 185
7,891,201 B1 * 2/2011 Bush ..... F25B 9/008 62/115
(Continued)

FOREIGN PATENT DOCUMENTS

CN 2293690 Y 10/1998
CN 201096431 Y 8/2008
(Continued)

OTHER PUBLICATIONS

CN-104142033-A English Machine Translation (Year: 2014).*
(Continued)

*Primary Examiner* — Jenna M Maroney
(74) *Attorney, Agent, or Firm* — Kilpatrick Townsend & Stockton LLP

(57) ABSTRACT

A carbon dioxide refrigerating system and a refrigerating method thereof. A carbon dioxide refrigerating system, comprising a compressor, a condenser, a liquid storage device, and an evaporator connected in sequence; a suction assembly is arranged between the compressor and the condenser, the suction assembly being in communication with
(Continued)

the liquid storage device and in communication with a gas-liquid separator, the gas-liquid separator being arranged between the condenser and the liquid storage device, and the carbon dioxide gas in the liquid storage device or the gas-liquid separator being capable of being sucked back into the pipeline between the compressor and the condenser by means of the suction assembly.

20 Claims, 13 Drawing Sheets

(51) Int. Cl.
*F25B 41/39* (2021.01)
*F28D 5/02* (2006.01)

(56) References Cited

U.S. PATENT DOCUMENTS

| | | | | |
|---|---|---|---|---|
| 9,243,847 | B2 * | 1/2016 | Benz | F28F 27/003 |
| 12,152,838 | B2 * | 11/2024 | Yang | F28B 1/06 |
| 2003/0071373 | A1 * | 4/2003 | Hubbard | F28F 25/00 261/DIG. 11 |
| 2018/0283754 | A1 | 10/2018 | Prins et al. | |
| 2020/0124330 | A1 * | 4/2020 | Hayes | F25B 40/06 |

FOREIGN PATENT DOCUMENTS

| | | | | |
|---|---|---|---|---|
| CN | 102878732 | A | | 1/2013 |
| CN | 203148265 | U | * | 8/2013 |
| CN | 203286822 | U | | 11/2013 |
| CN | 104142033 | A | * | 11/2014 |
| CN | 105114664 | A | | 12/2015 |
| CN | 105805362 | A | | 7/2016 |
| CN | 205401831 | U | | 7/2016 |
| CN | 105910318 | A | | 8/2016 |
| CN | 206647571 | U | | 11/2017 |
| CN | 207317335 | U | | 5/2018 |
| CN | 207572499 | U | | 7/2018 |
| CN | 109724283 | A | | 5/2019 |
| CN | 109737639 | A | | 5/2019 |
| CN | 109838583 | A | | 6/2019 |
| CN | 109945377 | A | | 6/2019 |
| CN | 110319613 | A | | 10/2019 |
| DE | 102011108020 | A1 | | 4/2012 |
| EP | 2433042 | B1 | | 7/2013 |
| JP | H0875283 | A | | 3/1996 |
| JP | 2008008577 | A | * | 1/2008 |
| KR | 20100091657 | A | | 8/2010 |
| WO | 2017067860 | A1 | | 4/2017 |

OTHER PUBLICATIONS

JP-2008008577-A English Machine Translation (Year: 2008).*
CN-203148265-U English Machine Translation (Year: 2013).*
European Patent Office, Extended European Search Report Issued in Application No. 20843308.6, Jul. 6, 2023, Germany, 6 pages.
State Intellectual Property Office of the People's Republic of China, 1st Office Action Issued in Application No. 201911121638.X(Chinese counterpart application), Feb. 2, 2021, 18 pages.
State Intellectual Property Office of the People's Republic of China, 1st Office Action Issued in Application No. 201911122549.7(Chinese priority patent application ), Feb. 2, 2021, 23 pages.

* cited by examiner

CARBON DIOXIDE REFRIGERATING SYSTEM AND REFRIGERATING METHOD THEREOF

CROSS-REFERENCES

This application is the national phase of international application No. PCT/CN2020/085061, titled "CARBON DIOXIDE REFRIGERATING SYSTEM AND REFRIGERATING METHOD THEREOF", filed on Apr. 16, 2020, which claims the benefit of priorities to the following two Chinese patent applications, all of which are incorporated herein by reference, 1) Chinese Patent Application No. 201921160257.8, titled "SINGLE-STAGE CARBON DIOXIDE REFRIGERATION SYSTEM", filed with the China National Intellectual Property Administration on Jul. 22, 2019; and
2) Chinese Patent Application No. 201911122549.7, titled "CARBON DIOXIDE REFRIGERATING SYSTEM AND REFRIGERATING METHOD THEREOF", filed with the China National Intellectual Property Administration on Nov. 15, 2019.

FIELD

The present application relates to the technical field of refrigeration, and in particular to a carbon dioxide refrigeration system and a refrigeration method thereof.

BACKGROUND

In the field of refrigeration, Freon is generally used as a refrigerant worldwide. However, Freon may destroy the atmospheric ozone layer, resulting in a high greenhouse effect. Due to the instability and high cost of ammonia (R717), there will be unsafe factors in a refrigeration system using ammonia, so ammonia (R717) is not an economical and safe refrigerant. With the increasing attention of the international community to energy conservation, emission reduction, and environmental protection, the elimination of Freon refrigerant has accelerated. As a safe and environmentally friendly refrigerant, carbon dioxide has broad application prospect and considerable economic value. However, due to the inherent characteristics of carbon dioxide, in a case that a working temperature is higher than a critical temperature, the carbon dioxide cannot be fully liquefied, regardless of how high the applied pressure is and the use of existing conventional air-cooled condensers, water-cooled condensers, evaporation-cooled condensers, etc. Therefore, the extremely low carbon dioxide refrigeration efficiency limits the promotion and application of a carbon dioxide refrigeration system.

In order to improve the refrigeration efficiency of the carbon dioxide refrigeration system, the existing improvement methods are to use a two-stage carbon dioxide refrigeration system, to use a cascade refrigeration system with carbon dioxide as a low-temperature stage, or to use a refrigeration system with carbon dioxide as a secondary refrigerant. Although these improvements can improve the energy efficiency performance of the refrigeration system on the carbon dioxide side to a certain extent, the structure of the system is complex, the cost is high, the debugging and maintenance are difficult, and the efficiency of the overall refrigeration system is still low. In addition, in the cascade system and the secondary refrigeration system, other refrigerant (such as Freon) still needs to be added to maintain the normal operation of the system, which neither makes full use of the advantages of the natural working fluid carbon dioxide as a refrigerant, nor is conducive to environmental protection.

In summary, based on the characteristics of the carbon dioxide refrigerant, extensive research has been carried out. Due to different temperatures and humidity in different regions and great differences in winter and summer, there is still a technical prejudice that, the carbon dioxide refrigerant system is difficult to be used for refrigeration over a large span in a case that an ambient temperature is higher than the critical temperature of carbon dioxide. Therefore, how to overcome the influence of changes of temperature and humidity on the carbon dioxide refrigerant system has always been one of the research topics. Moreover, the condensed carbon dioxide liquid may contain some gas. It is the motivation for the present application to separate the gas in the condensed carbon dioxide liquid while further lowering the temperature of the carbon dioxide liquid, so that the carbon dioxide liquid is super-cooled.

SUMMARY

An object according to the present application is to overcome the disadvantages of the conventional technology, and provide a carbon dioxide refrigeration system, having a simple structure, convenient operation, low mounting and maintenance cost, high refrigeration efficiency and capability of adjusting the temperature of carbon dioxide liquid, and a refrigeration method thereof.

The technical solution of the carbon dioxide refrigeration system provided according to the present application is as follows:

A carbon dioxide refrigeration system includes a compressor, a condenser, a liquid reservoir and an evaporator which are connected in a listed sequence. A suction assembly is arranged between the compressor and the condenser, the suction assembly is in communication with the liquid reservoir or a gas-liquid separator, the gas-liquid separator is arranged between the condenser and the liquid reservoir, and carbon dioxide gas in the liquid reservoir or the gas-liquid separator can be sucked back into a pipeline between the compressor and the condenser by means of the suction assembly.

In one embodiment, the suction assembly includes a first port, a second port and a third port, the first port is in communication with the compressor, the second port is in communication with the condenser, and the third port is in communication with the liquid reservoir or the gas-liquid separator.

In one embodiment, the suction assembly is a venturi tube or a venturi group with multiple venturi tubes connected in parallel, and the gas-liquid separator is a float valve or a float valve group with multiple float valves connected in series.

In one embodiment, the suction assembly includes a three-way valve and a negative-pressure pump, the negative-pressure pump is arranged on a pipeline communicating the third port with the liquid reservoir or the gas-liquid separator, and the negative-pressure pump generates a set negative pressure in the liquid reservoir or the gas-liquid separator.

In one embodiment, a condensing pressure in a condensing tube is lower than 120 Kg/cm2, and a one-way valve is arranged between the gas-liquid separator and the suction assembly.

In one embodiment, the venturi tube includes a constricted segment, a throat segment and a flaring segment which are connected in a listed sequence.

In one embodiment, the float valve includes two ports arranged at the bottom and one port arranged at the top.

In one embodiment, the carbon dioxide refrigeration system includes a first venturi tube and a first float valve, wherein the first venturi tube is arranged on the pipeline between the compressor and the condenser, the first float valve is arranged on a pipeline between the condenser and the liquid reservoir, and a throat segment connecting port of the first venturi tube is connected to the first float valve;

or the carbon dioxide refrigeration system includes a first venturi tube, a first float valve, a second venturi tube and a second float valve, wherein the first venturi tube is arranged on a pipeline between the compressor and the condenser, the first float valve and the second float valve are connected in series on a pipeline between the condenser and the liquid reservoir, a throat segment connecting port of the first venturi tube is connected to the first float valve, the second venturi tube is arranged between the first float valve and the condenser, and a throat segment connecting port of the second venturi tube is connected to the second float valve;

or the carbon dioxide refrigeration system includes a first venturi tube, a first float valve, a second venturi tube, a second float valve, a third venturi tube and a third float valve, wherein the first venturi tube is arranged on a pipeline between the compressor and the condenser, the first float valve, the second float valve and the third float valve are connected in series on a pipeline between the condenser and the liquid reservoir, a throat segment connecting port of the first venturi tube is connected to the first float valve, the second venturi tube is arranged between the first float valve and the condenser, a throat segment connecting port of the second venturi tube is connected to the second float valve; the third venturi tube is arranged between the first float valve and the second float valve, and a throat segment connecting port of the third venturi tube is connected to the third float valve;

or the carbon dioxide refrigeration system includes a first venturi tube, a first float valve, a second venturi tube, a second float valve, and a third venturi tube, wherein the first venturi tube is arranged on a pipeline between the compressor and the condenser, the first float valve and the second float valve are connected in series on a pipeline between the condenser and the liquid reservoir, a throat segment connecting port of the first venturi tube is connected to the first float valve, the second venturi tube is arranged between the first float valve and the condenser, a throat segment connecting port of the second venturi tube is connected to the second float valve; the third venturi tube is arranged between the first float valve and the second float valve, and a throat segment connecting port of the third venturi tube is connected to the liquid reservoir;

or the carbon dioxide refrigeration system includes one venturi tube and more than one float valves, the venturi tube is arranged on a pipeline between the compressor and the condenser, the more than one float valves are connected in series on a pipeline between the condenser and the liquid reservoir, and the more than one float valves are all connected to a throat segment connecting port of the venturi tube.

In one embodiment, the condenser is a flash-evaporation condenser, the flash-evaporation condenser includes a housing, a negative-pressure fan, a heat exchange device and a liquid atomization device, wherein the negative-pressure fan is arranged on the housing, the negative-pressure fan forms a negative-pressure environment inside the housing, the liquid atomization device and the heat exchange device are arranged in the housing, the liquid atomization device sprays an atomized liquid into the housing, and the atomized liquid evaporates into vapor in the negative-pressure environment to condense and liquefy a carbon dioxide medium in the heat exchange device.

In one embodiment, an exhaust amount of the negative-pressure fan is greater than an evaporation amount of the atomized liquid in the housing; and a pressure of a static pressure chamber in the housing is lower than an ambient atmospheric pressure by more than 20 Pa.

In one embodiment, a condensing pressure in a condensing tube is not higher than a critical pressure of the carbon dioxide, and the critical pressure of the carbon dioxide is 74 Kg/cm2.

In one embodiment, a first static pressure chamber is formed between the negative-pressure fan and the heat exchange device, a second static pressure chamber is formed between the liquid atomization device and the heat exchange device, the negative-pressure fan forms a negative-pressure environment in the second static pressure chamber, and the liquid atomization device sprays the atomized liquid into the second static pressure chamber to evaporate the atomized liquid into vapor.

In one embodiment, the flash-evaporation condenser includes a pressure regulating device, a gas inlet of the pressure regulating device is arranged outside the housing, an air outlet of the pressure regulating device is arranged inside the housing, a regulating air flow is sent into the housing by means of the pressure regulating device to promote the flow of the vapor in the housing and form an aerosol in the housing;

or the pressure regulating device is one or more fans, and the one or more fans are arranged close to the liquid atomization device;

or the pressure regulating device is a negative-pressure fan connected to the housing through a vapor circulation pipeline.

In one embodiment, the refrigeration system includes a four-way reversing valve, wherein the four-way reversing valve includes a valve body; a first outlet, a second outlet, a third outlet and a fourth outlet are defined on the valve body, a gas passage is defined inside the valve body, the gas passage communicates the first outlet, the second outlet, the third outlet and the fourth outlet; a first valve core assembly and a second valve core assembly are provided in the valve body, and the first valve core assembly and the second valve core assembly are movable inside the valve body to switch a communication relationship between the air outlets; and the first valve core assembly and the second valve core assembly are moved by a pressure generated by a high-pressure power gas source.

In one embodiment, each of the first valve core assembly and the second valve core assembly includes a spring, two valve cores, a screw rod, a valve tube and a shaft sleeve, wherein two ends of the screw rod are respectively connected to the two valve cores, one end of the spring is connected to one of the two valve cores, and another end of the spring is connected to a spring fixing base, the valve tube is sleeved on the screw rod, a side of the valve tube facing the outlet has an open structure, the open structure allows gas to enter an interior of the four-way reversing valve, the shaft sleeve is arranged on the valve core, the shaft sleeve cooperates with the valve tube to prevent carbon dioxide gas from passing through;

the valve body includes an upper sealing plate and a lower sealing plate which cooperate with each other, and a valve cover is provided on the valve body.

In one embodiment, the carbon dioxide refrigeration system includes a first four-way reversing valve, a second four-way reversing valve and a third four-way reversing valve; wherein four outlets of the first four-way reversing valve are respectively connected to an inlet of the condenser, an inlet of the compressor, an outlet of the compressor and an outlet of the evaporator through a gas pipeline; two outlets of the second four-way reversing valve are respectively connected to an outlet of the condenser and an inlet of the gas-liquid separator through the gas pipeline, and the other two outlets of the second four-way reversing valve are respectively connected to two outlets of the third four-way reversing valve; two outlets of the third four-way reversing valve are respectively connected to an outlet of the liquid reservoir and an inlet of the evaporator, and the other two outlet of the third four-way reversing valve are respectively connected to the other two outlets of the second four-way reversing valve.

In one embodiment, in a refrigeration mode, the first four-way reversing valve communicates the outlet of the compressor with the inlet of the condenser, and communicates the outlet of the evaporator with the inlet of the compressor; the second four-way reversing valve communicates the outlet of the condenser with the inlet of the gas-liquid separator, and communicates with the third four-way reversing valve; the third four-way reversing valve communicates the outlet of the liquid reservoir with the inlet of the evaporator, and communicates with the second four-way reversing valve;

in a heating mode, the first four-way reversing valve communicates the outlet of the compressor with the evaporator, and communicates the inlet of the condenser with the inlet of the compressor; the second four-way reversing valve communicates the outlet of the condenser with the third four-way reversing valve, and communicates the third four-way reversing valve with the inlet of the gas-liquid separator; the third four-way reversing valve communicates the outlet of the liquid reservoir with the second four-way reversing valve, and communicates the evaporator with the second four-way reversing valve.

In one embodiment, the carbon dioxide refrigeration system is used as an air conditioner configured to adjust indoor temperature, or a cold source of a cold storage or quick freezing storage.

In one embodiment, the liquid reservoir for storing the liquid carbon dioxide is connected to a carbon dioxide fire-fighting pipeline, and the liquid reservoir for storing the liquid carbon dioxide is arranged below a frozen soil layer.

In one embodiment, an overflow differential pressure valve is arranged between the condenser and the liquid reservoir, the overflow differential pressure valve includes a differential pressure valve housing, a sealing gasket, a differential pressure valve inlet and a differential pressure valve outlet, wherein the differential pressure valve inlet is in communication with the differential pressure valve outlet, and the differential pressure valve outlet is in communication with the liquid reservoir; the sealing gasket is arranged in a chamber formed inside the differential pressure valve housing, the differential pressure valve inlet and the differential pressure valve outlet are both in communication with the chamber formed inside the differential pressure valve housing, and the sealing gasket is movable in the differential pressure valve housing according to a pressure change to realize the communication or occlusion between the differential pressure valve inlet and the differential pressure valve outlet.

In one embodiment, the overflow differential pressure valve further includes a differential pressure valve spring, wherein one end of the differential pressure valve spring is connected to the sealing gasket, another end of the differential pressure valve spring is fixed on the differential pressure valve housing, a shape of the sealing gasket matches a sectional shape of the chamber formed inside the differential pressure valve housing, and the sealing gasket moves back and forth with the compression or release of the differential pressure valve spring.

In one embodiment, the carbon dioxide refrigeration system includes a low-pressure circulation barrel, wherein a liquid outlet of the low-pressure circulation barrel is in communication with an inlet end of the evaporator, an outlet end of the evaporator is in communication the low-pressure circulation barrel, and a gas outlet of the low-pressure circulation barrel is in communication with the compressor.

A refrigeration method using carbon dioxide as a medium is further provided according to the present application, which includes the following steps:

(1), compressing high-pressure carbon dioxide gas in an evaporator into a condenser by a compressor for cooling;

(2), sucking the carbon dioxide gas mixed in carbon dioxide liquid away by a suction assembly to achieve gas-liquid separation; flash-evaporating part of the carbon dioxide liquid by the suction assembly, performing multi-stage cooling to cause the liquid carbon dioxide to be in a super-cooled state; and (3), introducing the super-cooled carbon dioxide liquid into a liquid reservoir for use.

In one embodiment, in step (1), the carbon dioxide gas is completely condensed and liquefied in a flash-evaporation condenser by a flash-evaporation condensation method, wherein a heat exchange device and a liquid atomization device are arranged in a closed housing, a negative-pressure fan is arranged on the closed housing, a liquid is sprayed through the high-pressure liquid atomization device to form an atomized liquid with a large specific surface area, and is dispersed in an accommodating chamber of the housing; under the radiant heat generated by the heat exchange device and the negative pressure generated by the negative-pressure fan, small particles of the atomized liquid are dispersed and suspended in a gas medium to form an aerosol, so that water molecules on a surface of the atomized liquid depart from droplet bodies, transform into vapor and take away heat;

in step (2), the multi-stage cooling is realized by providing multiple float valves connected in series, the carbon dioxide liquid passes through the multiple float valves in sequence, the multiple float valves are respectively connected to the suction assembly, part of the liquid carbon dioxide is gasified under a suction force, so that the remaining liquid carbon dioxide is in the super-cooled state, and a liquid carbon dioxide with a lower temperature is obtained. Such arrangement can control the required temperature of the carbon dioxide liquid.

The implementation of the present application includes the following technical effects.

1, the suction assembly is arranged between the compressor and the condenser, and can suck away the carbon dioxide ($CO_2$) gas stored in the liquid reservoir or the gas-liquid separator, and transport it back to the condenser for re-condensation, to increase a condensation amount of the carbon dioxide gas. Another function is that the suction assembly can flash-evaporate part of the liquid, the carbon dioxide after flash-evaporation can take away part of the heat and can further lower the temperature of the liquid carbon dioxide, so that the liquid carbon dioxide in the super-cooled state. Due to the re-cooling function, such structure reduces the impact on the system after the efficiency of the condenser is reduced in the case of over high outside temperature and humidity, so that the refrigeration efficiency of the system is improved. Part of the carbon dioxide liquid can be liquefied in a case that the ambient temperature is higher than the critical temperature of the carbon dioxide. Further, since the temperature in the condenser may be lower than the critical temperature of the carbon dioxide, the required carbon dioxide liquid can be obtained through the secondary cooling function of the suction assembly. If the flash-evaporation condenser according to the present application is used, the influence of the temperature and humidity of the external environment can be overcome.

2, the natural working fluid carbon dioxide is used as the only refrigerant in the entire refrigeration system, which will not cause any damage to the ecological environment even if it is leaked. Since the critical temperature of the carbon dioxide is low, which is only 31.06 degrees Celsius, and the efficiency of the system is low during the trans-critical circulation. The carbon dioxide can be fully refrigerated and the required degree of super-cooling can be obtained by arranging the suction assembly and the flash-evaporation condenser according to the present application. The carbon dioxide medium adopted in the present application is rich in nature, easy to obtain, low in cost and price, is environmentally friendly (ODP=0, GWP=1), has good safety, is non-toxic and non-flammable, and has a large refrigeration capacity per unit volume, which is 4 to 8 times that of Freon.

3, the single-stage or multi-stage cooling system composed of the suction assembly and the gas-liquid separator can cool the liquid carbon dioxide to a required temperature, and has a simple structure, convenient operation, and low mounting and maintenance costs.

4, the improved flash-evaporation condenser according to the present application has the following technical effects.

(1), by promoting the evaporation of the atomized liquid in the closed negative-pressure environment, the overall temperature in the closed environment is lowered. The heat exchange device can achieve the refrigeration effect through radiation in a low-temperature environment, which is not affected by the temperature and humidity of external natural wind, and can be used in various areas with different environments. In the negative-pressure environment, the small particles of the atomized liquid are dispersed and suspended in the gas medium to form a colloidal dispersion system, forming the aerosol. Since the dispersion medium of the aerosol is gas with a small viscosity, the density difference between the dispersed phase and the dispersion medium is large, the particles are extremely easy to bond when they collide, and further due to the volatilization of the liquid particles, the aerosol has its unique regularity. The aerosol particles have a considerable specific surface and surface energy, which can evaporate the liquefied liquid quickly and improve the refrigeration effect. The atomized liquid generated by the liquid atomization device flash-evaporates quickly in the negative-pressure environment of the accommodating chamber, transforms from liquid mist phase into vapor, and absorbs heat, reducing the ambient temperature in the housing. The vapor flash-evaporated from the atomized liquid can be discharged out of the housing through the negative-pressure fan. Therefore, the atomized liquid in the accommodating chamber continuously evaporates into vapor and releases cold capacity. The vapor is continuously discharged out of the housing through the negative-pressure fan to refrigerate. The low-temperature environment in the housing can be used to cool and lower the temperature of a substance.

(2), since convection heat exchange with the external environment is not required in the refrigeration process, the flash-evaporation closed condenser according to the present application has a small installed capacity, and the entire equipment occupies a small space, which is convenient for mounting and saves space.

(3), the flash-evaporation closed condenser according to the present application realizes refrigeration completely through the evaporation of the atomized liquid. The process of liquid transforming from liquid to gas can release the cold capacity for refrigeration, and the temperature of the vapor discharged by the equipment may not rise. Therefore, in the refrigeration process, there is actually no heat discharged into the atmosphere and heat island effect will not be formed. The refrigeration system has a high refrigeration efficiency, and a stable and reliable refrigeration effect.

Figure 1:
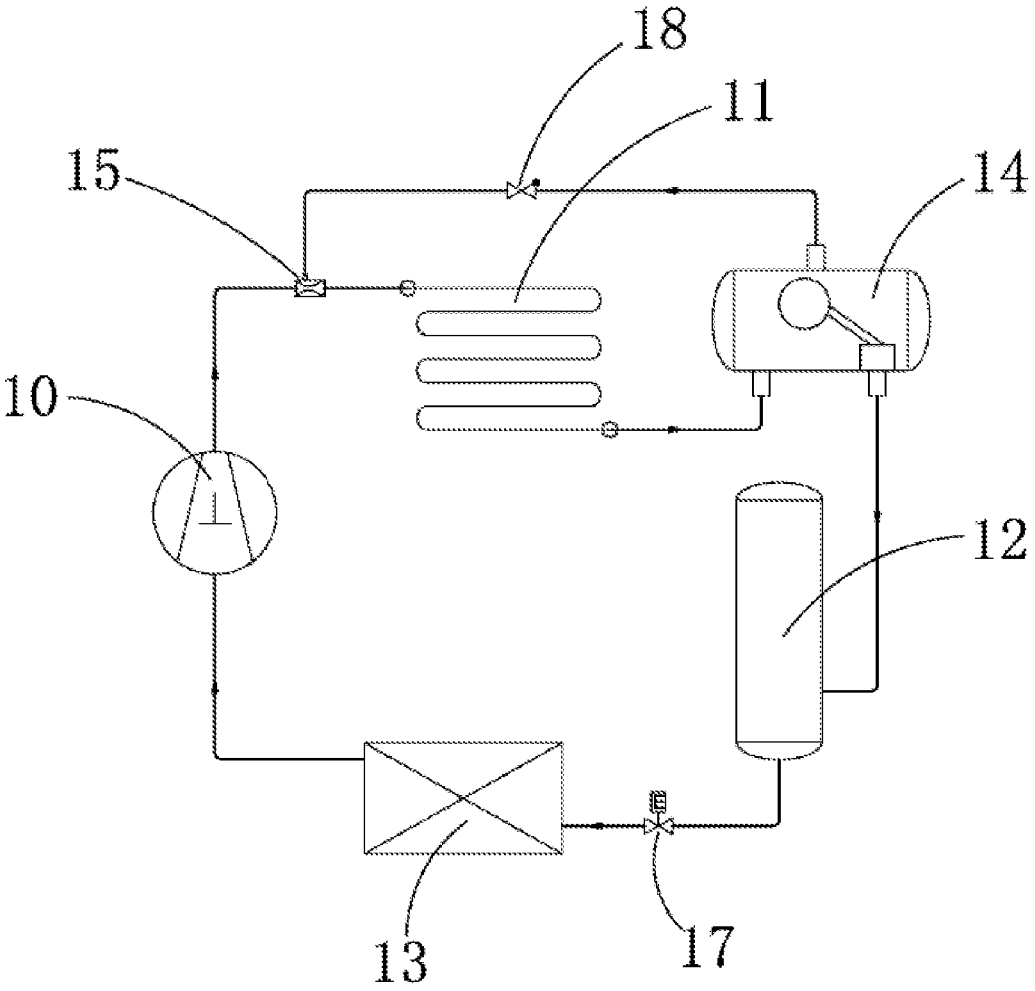
FIG. 1 is a schematic structural view of a carbon dioxide refrigeration system according to the present application.

Reference numerals in the drawings are listed as follows:

| | |
|---|---|
| 10 compressor; | 11 condenser; |
| 12 liquid reservoir; | 13 evaporator; |
| 14 gas-liquid separator; | 15 suction assembly; |
| 150 first port; | 151 second port; |
| 152 third port; | 153 constricted segment; |
| 154 throat segment; | 155 flaring segment; |
| 156 negative-pressure pump; | 16 solenoid valve; |
| 17 regulating expansion valve; | 18 one-way valve; |
| 20 first venturi tube; | 21 second venturi tube; |
| 22 third venturi tube; | 23 first float valve; |
| 24 second float valve; | 25 third float valve; |
| 26 negative-pressure fan; | 27 housing; |
| 28 heat exchange device; | 29 liquid atomization device; |
| 30 first static pressure chamber; | 31 second static pressure chamber; |
| 32 pressure regulating device; | 33 water replenishing device; |
| 34 vapor circulation pipeline; | 35 first four-way reversing valve; |
| 350 upper sealing plate; | 351 lower sealing plate; |
| 352 first outlet; | 353 second outlet; |
| 354 third outlet; | 355 fourth outlet; |
| 356 first valve core assembly; | 357 second valve core assembly; |
| 358 spring fixing base; | 359 spring; |
| 360 valve core; | 361 screw rod; |
| 362 valve tube; | 363 shaft sleeve; |
| 364 valve cover; | 365 power gas source inlet; |
| 36 second four-way reversing valve; | 37 third four-way reversing valve; |
| 38 overflow differentia pressure valve; | 380 sealing gasket; |
| 381 differential pressure valve spring; | 382 differential pressure valve housing; |
| 383 differential pressure valve inlet; | 384 differential pressure valve outlet; |
| 39 low-pressure circulation barrel. | |

DETAILED DESCRIPTION OF THE EMBODIMENTS

The present application will be described in detail below with reference to the embodiments and the drawings. It should be noted that the described embodiments are only intended to facilitate the understanding of the present application and do not limit the present application.

First Embodiment

Figure 19:
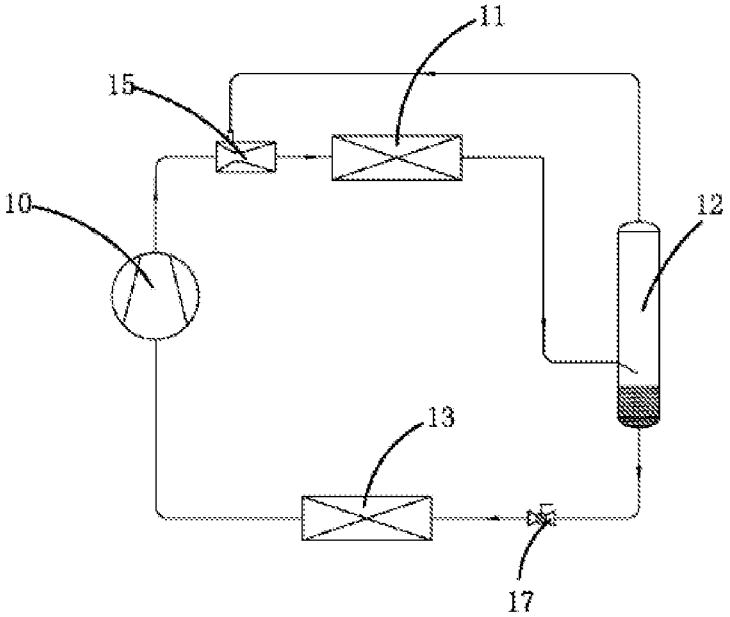
FIG. 19 is a schematic structural view of a suction assembly directly connected to a liquid reservoir.

Referring to FIG. 1, a carbon dioxide refrigeration system provided by this embodiment includes a compressor 10, a condenser 11, a liquid reservoir 12 and an evaporator 13 which are connected in a listed sequence. After entering the condenser 11, a carbon dioxide gas discharged from the compressor 10 is condensed into a liquid and stored in the liquid reservoir 12. The carbon dioxide liquid is evaporated and cooled in the evaporator 13 and flows back to the compressor 10 for reuse, to realize the circulation of the carbon dioxide. A suction assembly 15 is arranged between the compressor 10 and the condenser 11, the suction assembly 15 is in communication with the liquid reservoir 12 (as shown in FIG. 19) or a gas-liquid separator 14 (as shown in FIG. 1), the gas-liquid separator 14 is arranged between the condenser 11 and the liquid reservoir 12, and the carbon dioxide gas in the liquid reservoir 12 or the gas-liquid separator 14 can be sucked back into a pipeline between the compressor 10 and the condenser 11 by means of the suction assembly 15, and enters the condenser 11 again for further condensation. Liquid can pass through the gas-liquid separator 14, while gas cannot pass there through.

In this embodiment, the suction assembly 15 is arranged between the compressor 10 and the condenser 11, and can suck away the carbon dioxide gas stored in the liquid reservoir 12 or the gas-liquid separator 14, and transport it back to the condenser 11 for re-condensation, to increase a condensation amount of the carbon dioxide gas. Another function is that the suction assembly 15 can flash-evaporate part of the liquid, the carbon dioxide after flash-evaporation can take away part of the heat and can further lower the temperature of the liquid carbon dioxide, so that the liquid carbon dioxide in a super-cooled state. Due to the re-cooling function, such structure reduces the impact on the system after the efficiency of the condenser 11 is reduced in the case of over high outside temperature and humidity, so that the refrigeration efficiency of the system is improved. Part of the carbon dioxide liquid can be liquefied in a case that the ambient temperature is higher than the critical temperature of the carbon dioxide. Further, since the temperature in the condenser may be lower than the critical temperature of the carbon dioxide, the required carbon dioxide liquid can be obtained through the secondary cooling function of the suction assembly. If the flash-evaporation condenser according to the present application is used, the influence of the temperature and humidity of the external environment can be overcome.

In this embodiment, the compressor 10 continuously sucks away the carbon dioxide gas in the evaporator 13 to maintain the environment in the evaporator 13 in a low-temperature and low-pressure state, which promotes the continuous gasification and refrigeration of the liquid carbon dioxide. Besides, the compressor 10 compresses the sucked carbon dioxide gas, so that the temperature and the pressure of the carbon dioxide gas are greatly increased, to improve the heat exchange efficiency with the condenser 11. The high-temperature and high-pressure carbon dioxide gas enters the condenser 11, and is cooled in the condenser 11, and a part of the gaseous carbon dioxide is condensed into liquid to form a low-temperature and high-pressure carbon dioxide gas-liquid mixture. The carbon dioxide gas-liquid mixture enters the liquid reservoir 12 or the gas-liquid separator 14, and completes the gas-liquid separation in the liquid reservoir 12 or the gas-liquid separator 14.

Figure 2:
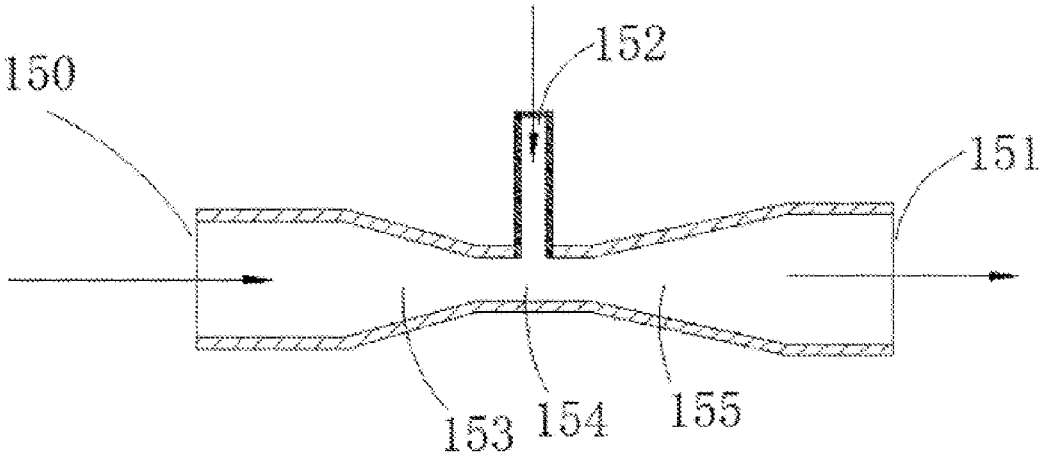
FIG. 2 is a schematic structural view of a first suction assembly (a venturi tube)
Figure 3:
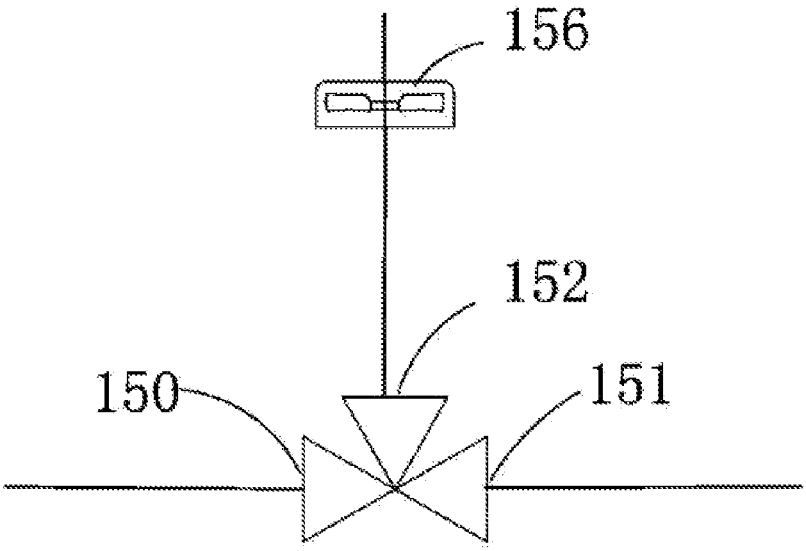
FIG. 3 is a schematic structural view of a second suction assembly (a three-way valve and a negative-pressure pump)

Referring to FIG. 2 and FIG. 3, the suction assembly 15 includes a first port 150, a second port 151 and a third port 152, wherein the first port 150 is in communication with the compressor 10, the second port 151 is in communication with the condenser 11, and the third port 152 is in communication with the liquid reservoir 12 or the gas-liquid separator 14. The first port 150 and the second port 151 are configured to communicate the compressor 10 with the condenser 11, and the third port 152 allows the suction assembly 15 to suck back the gaseous carbon dioxide in the gas-liquid separator 14 or a float valve, and the gaseous carbon dioxide again flows into the condenser 11 for cooling.

Figure 4:
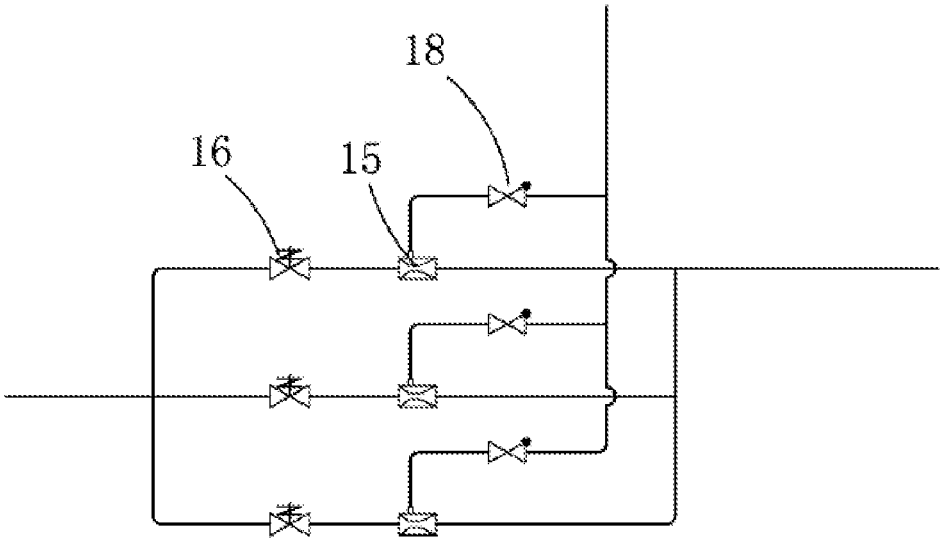
FIG. 4 is a schematic structural view of three suction assemblies (a venturi group) arranged in parallel.

Specifically, referring to FIG. 2 and FIG. 4, the suction assembly 15 is a venturi tube or a venturi group with multiple venturi tubes connected in parallel. The venturi tube includes a constricted segment 153, a throat segment 154 and a flaring segment 155 which are connected in a listed sequence. The first port 150 of the suction assembly 15 is in communication with the constricted segment 153, the second port 151 is in communication with the flaring segment 155, and the third port 152 is in communication with the throat segment 154. The compressor 10 in the refrigeration system may include one compressor 10 or two or more compressor groups connected in parallel. The evaporator 13 may include one evaporator 13 or two or more evaporator groups, which may be arranged according to actual needs. Referring to FIG. 4, a solenoid valve 16 is arranged between the suction assembly 15 and the compressor 10, and a one-way valve 18 is arranged between the suction assembly 15 and the gas-liquid separator 14. By providing the solenoid valve 16 and the one-way valve 18, the safe operation of the system can be ensured, and the one-way valve can further prevent the high-temperature carbon dioxide gas from entering the gas-liquid separator.

Referring to FIG. 2, as an example, the venturi tube is in a hollow short-cylindrical shape, and the constricted segment 153 is a hollow conical tube, which gradually tapers. A rear portion of the constricted segment 153 is connected to the throat segment 154, which is in a hollow thin-cylindrical shape, and a diameter of the throat segment 154 is smaller than a diameter of an inlet segment. A rear portion of the throat segment 154 is connected to the flaring segment 155, which is a hollow conical tube. An end of the flaring segment 155 connected to the throat 154 segment is relatively narrow, and another end away from the throat segment 154 gradually expands.

The third port 152 for suction gas is defined at the throat segment 154 of the venturi tube, and the third port 152 is in communication with the gas-liquid separator 14 or the liquid reservoir 12. During the operation of the refrigeration system, the venturi tube can automatically suck the carbon dioxide gas in the liquid reservoir 12, so that the carbon dioxide gas in the liquid reservoir 12 enters the condenser 11 again for secondary condensation, to be transformed into carbon dioxide liquid and stored in the liquid reservoir 12.

In combination with the above description of the structure of the venturi tube, the working principle of the venturi tube is described in detail.

The venturi tube is an application form based on the Venturi effect. The Venturi effect means that, when a restricted flow passes through a constricted flow section, a flow velocity of the fluid increases, and the velocity is inversely proportional to the flow section. Generally speaking, this effect means that a low pressure may be generated near a high-speed fluid, resulting in adsorption. The venturi tube accelerates the gas flow by throttling the gas flow. Low pressure generated near the high-speed gas may generate a negative-pressure environment inside the venturi tube, and the negative-pressure environment may have a certain adsorption effect on the communicated external environment.

Specifically, referring to FIG. 1 and FIG. 2, the carbon dioxide gas compressed by the compressor 10 passes through the venturi tube before entering the condenser 11. The carbon dioxide gas first enters the inlet segment from a gas inlet of the venturi tube, and the gas flow is throttled when passing through the constricted segment 153 since the diameter of the tube gradually decreases, so that the flow velocity of the gas gradually increases. The flow velocity reaches the highest when the carbon dioxide gas enters the throat segment 154. At this time, a low pressure may be generated near the carbon dioxide gas in the throat segment 154 based on the Venturi effect, so that a negative-pressure environment is formed in the throat segment 154. The throat segment 154 is in communication with a space for storing the carbon dioxide gas in the gas-liquid separator 14 or the liquid reservoir 12. Under the adsorption effect of the negative-pressure environment in the throat segment 154, the carbon dioxide gas stored in the liquid reservoir 12 may be sucked into the venturi tube, and enters the flaring segment 155 of the venturi tube with the carbon dioxide gas compressed by the compressor 10, to reduce the flow velocity of the gas. Since the carbon dioxide gas compressed by the compressor 10 continuously passes through the venturi tube, the carbon dioxide gas stored in the liquid reservoir 12 also continuously flows into the venturi tube, and enters the condenser 11 together with the carbon dioxide gas compressed by the compressor 10 for heat exchange and condensation.

In addition, it should be noted that the above venturi tube does not need additional power during the operation process, that is, the venturi tube does not need a power component such as a motor, and the cyclic operation can be realized by relying on the physical properties of the carbon dioxide. The carbon dioxide itself has the characteristics of high critical pressure (relatively high pressure in a gaseous state) and low critical temperature (easy to maintain gaseous state at a low temperature). Compared with other refrigerants, the flow velocity of the carbon dioxide refrigerant in the venturi tube is higher, and the generated low pressure is lower, so that the negative-pressure environment in the venturi tube has a stronger adsorption effect. Therefore, the physical properties of the carbon dioxide refrigerant can maintain and promote the rapid and efficient operation of the suction assembly 15.

Based on the cyclic operation of the above suction assembly 15, the carbon dioxide gas in the gas-liquid separator 14 or the liquid reservoir 12 can continuously and repeatedly enter the condenser 11 for heat exchange and condensation, to increase the liquefaction amount of the carbon dioxide refrigerant, and obtain more liquid carbon dioxide in the gas-liquid separator 14 or the liquid reservoir 12, thus improving the refrigeration efficiency of the refrigeration system.

In addition, the carbon dioxide gas in the gas-liquid separator 14 or the liquid reservoir 12 is continuously sucked, which decreases the pressure in the gas-liquid separator 14 or the liquid reservoir 12. At this time, part of the liquid carbon dioxide may flash-evaporate into gas to maintain the balance of the overall ambient pressure in the gas-liquid separator 14 or the liquid reservoir 12. This part of liquid carbon dioxide absorbs heat in the process of flash-evaporating into gas, so that the temperature of the remaining liquid carbon dioxide in the gas-liquid separator 14 or the liquid reservoir 12 is decreased, that is, the super-cooling degree of the remaining liquid carbon dioxide is increased, further improving the refrigeration efficiency of the refrigeration system.

Besides, since the flash-evaporated carbon dioxide gas in the gas-liquid separator 14 or the liquid reservoir 12 is a low-temperature gas (about 13 degrees Celsius), the temperature of the high-temperature carbon dioxide gas may be decreased when the low-temperature gas is mixed with the high-temperature carbon dioxide gas (about 90 degrees Celsius) compressed by the compressor 10 in the venturi tube, that is, the high-temperature carbon dioxide gas is cooled once before entering the condenser 11 for condensation, and then the cooled gas enters the condenser 11 for cooling, which can improve the condensation efficiency of the condenser 11 and further promote the condensation and liquefaction of the carbon dioxide gas.

In summary, the suction assembly 15 composed of the venturi tube enables the carbon dioxide refrigeration system according to the present application to have the following advantages:

1, by combining the Venturi effect with the physical properties of the carbon dioxide, the gaseous carbon dioxide in the liquid reservoir 12 is repeatedly condensed without adding the power component and without affecting the efficiency of the compressor 10, which improves the refrigeration efficiency of the system;

2, the super-cooling degree of the liquid carbon dioxide in the liquid reservoir 12 is increased, which improves the refrigeration efficiency of the system;

3, compared with the existing carbon dioxide refrigeration system, the structure is simpler, and the operation effect is stable, which can realize the carbon dioxide single-stage cyclic refrigeration.

As another embodiment, referring to FIG. 3, the suction assembly 15 includes a three-way valve and a negative-pressure pump 156, the negative-pressure pump 156 is arranged on a pipeline communicating the third port 152 with the liquid reservoir 12 or the gas-liquid separator 14, and the negative-pressure pump 156 generates a set negative pressure in the liquid reservoir 12 or the gas-liquid separator 14. The negative-pressure pump 156 may be a small adjustable negative-pressure pump 156, which can adjust the pressure to pump away the gaseous carbon dioxide. In addition, the set negative pressure can cause the liquid carbon dioxide to flash-evaporate, to accurately adjust the super-cooling degree of the liquid carbon dioxide.

A condensing pressure in a condensing tube is greater than 30 Kg/cm2 and lower than 120 Kg/cm2, and a one-way valve 18 is arranged between the gas-liquid separator 14 and the suction assembly 15. A condensing pressure in the condenser 11 needs to be kept in an appropriate range (generally lower than 120 Kg/cm2, higher than an evaporating pressure of 30 Kg/cm2 to 40 Kg/cm2). Too high condensing pressure may affect the safe operation of the system, and too low condensing pressure may affect the normal operation of the system. The one-way valve 18 can keep the condensing pressure in an appropriate range and ensure the normal operation of the system.

Referring to FIGS. 5 to 8, the gas-liquid separator 14 is a float valve or a float valve group with multiple float valves connected in series. Carbon dioxide liquid can pass through the float valve, while carbon dioxide gas cannot pass there through, so that the gas-liquid separation is achieved. The float valve includes two ports arranged at the bottom and one port arranged at the top. The two ports at the bottom are respectively connected to the condenser 11 and the liquid reservoir 12, and the one port at the top is connected to the suction assembly 15. Such arrangement separates the liquid in the gas-liquid phase inside a float valve chamber, and a temperature of the gas-liquid phase is uniform.

Figure 5:
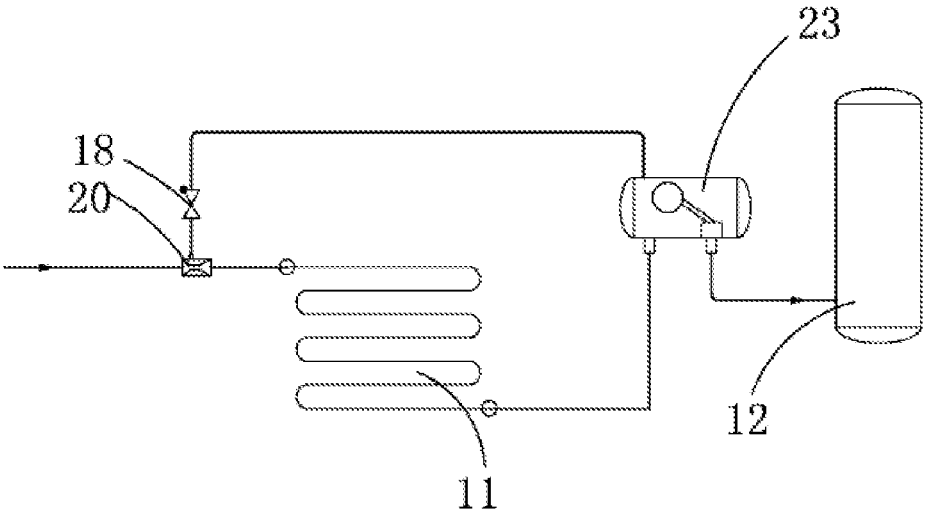
FIG. 5 is a schematic structural view of a primary cooling assembly.

Referring to FIG. 5, the carbon dioxide refrigeration system includes a first venturi tube 20 and a first float valve 23, wherein the first venturi tube 20 is arranged on the pipeline between the compressor 10 and the condenser 11, the first float valve 23 is arranged on a pipeline between the condenser 11 and the liquid reservoir 12, and a connecting port of the throat segment 154 of the first venturi tube 20 is connected to the float valve.

Figure 6:
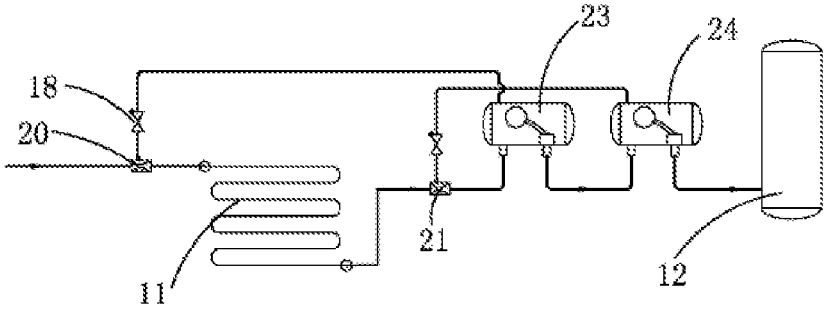
FIG. 6 is a schematic structural view of a secondary cooling assembly.

Referring to FIG. 6, the carbon dioxide refrigeration system includes a first venturi tube 20, a first float valve 23, a second venturi tube 21 and a second float valve 24, wherein the first venturi tube 20 is arranged on a pipeline between the compressor 10 and the condenser 11, the first float valve 23 and the second float valve 24 are connected in series on a pipeline between the condenser 11 and the liquid reservoir 12, a connecting port of the throat segment 154 of the first venturi tube 20 is connected to the first float valve 23, the second venturi tube 21 is arranged between the first float valve 23 and the condenser 11, and a connecting port of the throat segment 154 of the second venturi tube 21 is connected to the second float valve 24.

Figure 7:
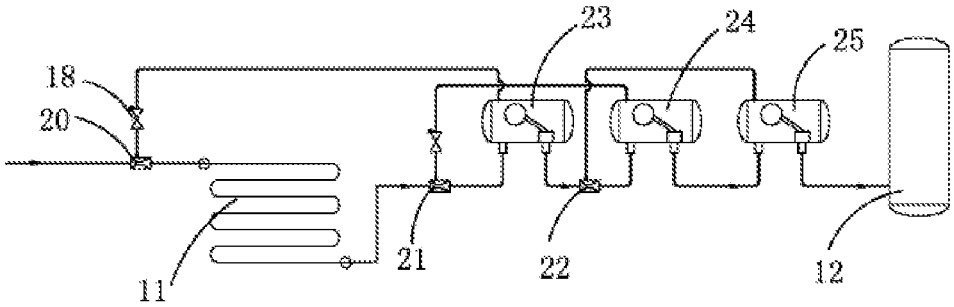
FIG. 7 is a schematic structural view of a three-stage cooling assembly.

Referring to FIG. 7, the carbon dioxide refrigeration system includes a first venturi tube 20, a first float valve 23, a second venturi tube 21, a second float valve 24, a third venturi tube 22 and a third float valve 25, wherein the first venturi tube 20 is arranged on a pipeline between the compressor 10 and the condenser 11, the first float valve 23, the second float valve 24 and the third float valve 25 are connected in series on a pipeline between the condenser 11 and the liquid reservoir 12, a connecting port of the throat segment 154 of the first venturi tube 20 is connected to the first float valve 23, the second venturi tube 21 is arranged between the first float valve 23 and the condenser 11, a connecting port of the throat segment 154 of the second venturi tube 21 is connected to the second float valve 24. The third venturi tube 22 is arranged between the first float valve 23 and the second float valve 24, and a connecting port of the throat segment 154 of the third venturi tube 22 is connected to the third float valve 25.

Figure 18:
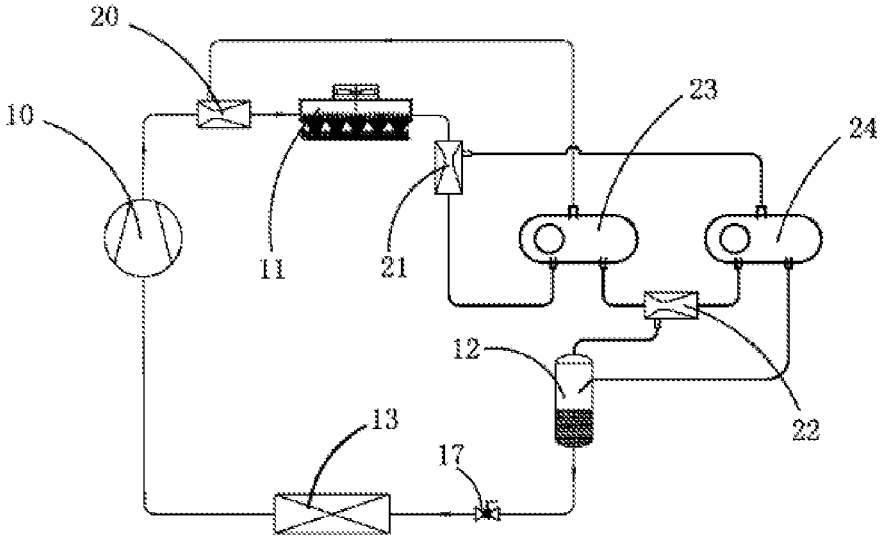
FIG. 18 is a schematic structural view showing another connection structure of the cooling assembly.

Referring to FIG. 18, the carbon dioxide refrigeration system includes a first venturi tube 20, a first float valve 23, a second venturi tube 21, a second float valve 24 and a third venturi tube 22, wherein the first venturi tube 20 is arranged on a pipeline between the compressor 10 and the condenser 11, the first float valve 23 and the second float valve 24 are connected in series on a pipeline between the condenser 11 and the liquid reservoir 12, a connecting port of the throat segment 154 of the first venturi tube 20 is connected to the first float valve 23, the second venturi tube 21 is arranged between the first float valve 23 and the condenser 11, and a connecting port of the throat segment 154 of the second venturi tube 21 is connected to the second float valve 24. The third venturi tube 22 is arranged between the first float valve 23 and the second float valve 24, and a connecting port of the throat segment 154 of the third venturi tube 22 is connected to the liquid reservoir 12. A regulating expansion valve 17 is arranged between the liquid reservoir and the evaporator 13.

Figure 8:
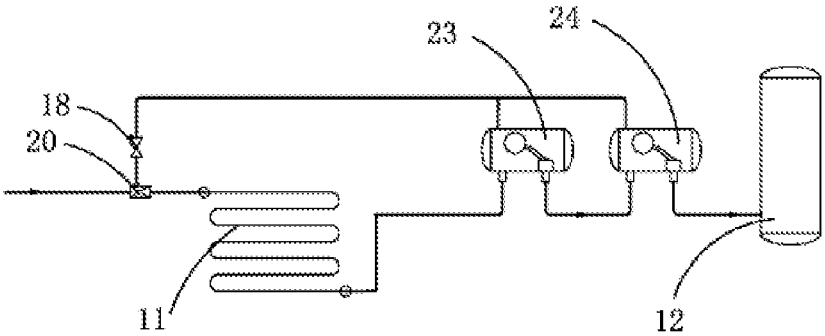
FIG. 8 is a schematic structural view showing another connection structure of the secondary cooling assembly.

Referring to FIG. 8, the carbon dioxide refrigeration system includes one venturi tube and more than one float valves, the venturi tube is arranged on a pipeline between the compressor 10 and the condenser 11, the more than one float valves are connected in series on a pipeline between the condenser 11 and the liquid reservoir 12, and the more than one float valves are all connected to a connecting port of the throat segment 154 of the venturi tube.

Further, the liquid reservoir for storing the liquid carbon dioxide is connected to a carbon dioxide fire-fighting pipeline, and the liquid reservoir for storing the liquid carbon dioxide is arranged below a frozen soil layer. The liquid carbon dioxide in the refrigeration system is used as a fire-fighting medium, to reduce the cost of fire-fighting construction. The temperature below the frozen soil layer is constant and about 15 degrees Celsius, which is lower than the critical temperature 31.06 degrees Celsius of the carbon dioxide. Thus, it can be ensured that the temperature of the carbon dioxide in a storage tank is 15 degrees Celsius, and the carbon dioxide is kept in a constant-temperature liquid state, which has a low storage cost. The carbon dioxide is used to extinguish fires and will not cause secondary damage to an object, which has a natural advantage. For a storage tank with the same volume, the amount of liquid storage is much greater than the amount of gaseous storage, and a fire extinguishing area is larger.

A refrigeration method using carbon dioxide as a medium is further provided according to this embodiment, which includes the following steps:

(1), compressing high-pressure carbon dioxide gas in an evaporator 13 into a condenser 11 by a compressor 10 for cooling, to obtain a carbon dioxide gas-liquid mixture or a supercritical fluid;

(2), performing gas-liquid separation and cooling on the cooled gas-liquid mixture or the supercritical fluid; sucking away the carbon dioxide gas mixed in the carbon dioxide liquid by a suction assembly 15, flash-evaporating part of the carbon dioxide liquid by the suction assembly 15, performing multi-stage cooling to cause the liquid carbon dioxide to be in a super-cooled state or to cause the supercritical fluid to transform into liquid; and wherein the multi-stage cooling is realized by providing multiple float valves connected in series, the carbon dioxide liquid passes through the multiple float valves in sequence, the multiple float valves are respectively connected to the suction assembly 15, and the liquid carbon dioxide is sequentially cooled down under a suction force. Such arrangement can control the required temperature of the carbon dioxide liquid.

(3), introducing the slightly super-cooled carbon dioxide liquid into a liquid reservoir 12 for use.

Second Embodiment

The difference between this embodiment and the first embodiment is that the condenser of this embodiment clearly is a flash-evaporation condenser, and the processes of the system are the same as the examples in the first embodiment. In the refrigeration system using carbon dioxide as a cooling medium, due to a low critical point of carbon dioxide, it is currently impossible to solve the problem that the gaseous carbon dioxide cannot be liquefied when the external temperature is too high. There is always a prejudice in this field that the refrigeration system using carbon dioxide as the cooling medium cannot be used for refrigeration over a large span and cannot be widely used. The applicant of the present application has been studying the refrigeration system using carbon dioxide as the refrigeration medium. The first developed ground-source condensing technology has been widely used. After years of research, a new flash-evaporation condensing technology has been developed, which solves the technical problem of condensing carbon dioxide medium for refrigeration, makes the condensing pressure of the carbon dioxide not higher than its critical pressure and the carbon dioxide be completely condensed and liquefied. Through the multi-stage supercooling, the condensing temperature is much lower than its critical temperature 31 degrees Celsius.

A refrigeration method using carbon dioxide as a medium based on a flash-evaporation condenser is further provided according to this embodiment, which includes the following steps:

(1), compressing high-pressure carbon dioxide gas in an evaporator 13 into a condenser 11 by a compressor 10 for condensing, to obtain a carbon dioxide fluid; wherein the carbon dioxide gas is condensed in a flash-evaporation condensation method, a heat exchange device and a liquid atomization device are arranged in a closed housing, a negative-pressure fan is arranged on the closed housing, a liquid is sprayed through the high-pressure liquid atomization device to form an atomized liquid with a large specific surface area, and is dispersed in an accommodating chamber of the housing; under the radiant heat generated by the heat exchange device and the negative pressure generated by the negative-pressure fan, small particles of the atomized liquid are dispersed and suspended in a gas medium to form an aerosol, so that water molecules on a surface of the atomized liquid depart from droplet bodies, transform into vapor and take away heat; many tests and applications have shown that the flash-evaporation condenser of this embodiment can completely liquefy the carbon dioxide.

(2), super-cooling the completely condensed carbon dioxide; wherein part of the liquid in the gas-liquid separator absorbs heat to gasify and is sucked away by a suction assembly 15, and then the remaining carbon dioxide liquid is cooled, and the liquid carbon dioxide is in a super-cooled state after a multi-stage cooling; wherein the multi-stage cooling is realized by providing multiple float valves connected in series, the carbon dioxide liquid passes through the multiple float valves in sequence, the multiple float valves are respectively connected to the suction assembly 15, and the liquid carbon dioxide is sequentially cooled down under a suction force. Such arrangement can control the required temperature of the carbon dioxide liquid.

(3), introducing the super-cooled carbon dioxide liquid into a liquid reservoir 12 for use.

Figure 9:
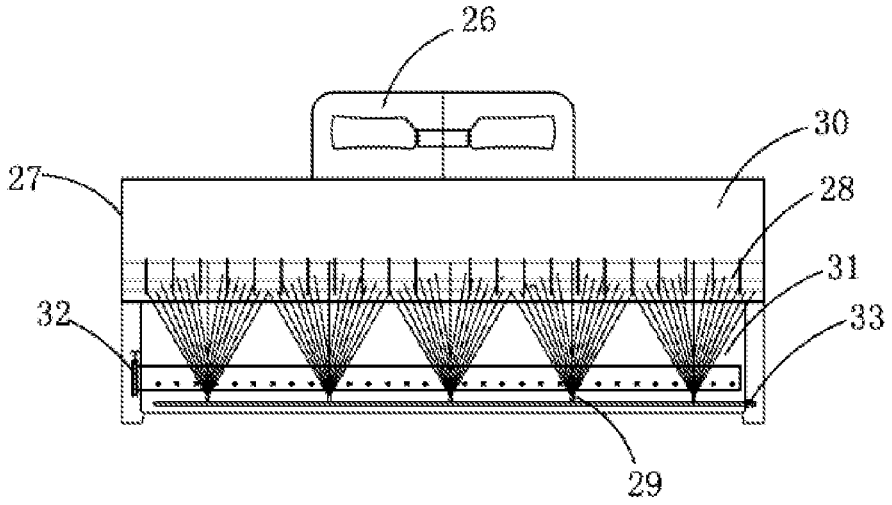
FIG. 9 is a schematic structural view of a first scheme of a flash-evaporation condenser.
Figure 10:
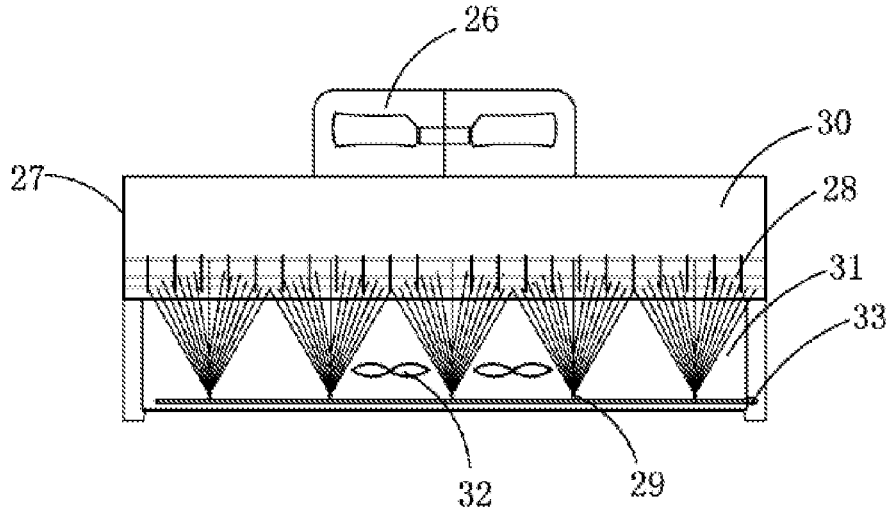
FIG. 10 is a schematic structural view of a second scheme of the flash-evaporation condenser.

Referring to FIGS. 9 and 10, the condenser 11 is a flash-evaporation condenser, the flash-evaporation condenser includes a housing 27, a negative-pressure fan 26, a heat exchange device 28 and a liquid atomization device 29, wherein the negative-pressure fan 26 is arranged on the housing 27, the negative-pressure fan 26 forms a negative-pressure environment inside the housing 27, the liquid atomization device 29 and the heat exchange device 28 are arranged in the housing 27, the liquid atomization device 29 sprays an atomized liquid into the housing 27, and the atomized liquid evaporates into vapor in the negative-pressure environment to condense and liquefy a carbon dioxide medium in the heat exchange device 28. The heat exchange device 28 is In one embodiment finned condensing tubes, and the condensing tubes are layered and crossed and arranged at a certain inclined angle.

Further, an exhaust amount of the negative-pressure fan 26 is greater than an evaporation amount of the atomized liquid in the housing 27. On one hand, the vapor in the housing 27 can be fully discharged, to improve the evaporation efficiency of the atomized liquid, and on the other hand, the negative-pressure environment in the housing 27 can be maintained. A pressure of a static pressure chamber in the housing 27 is lower than an ambient atmospheric pressure by more than 20 Pa. A condensing pressure in a condensing tube is not higher than a critical pressure of the carbon dioxide, and the critical pressure of the carbon dioxide is 74 Kg/cm2.

Referring to FIG. 9 and FIG. 10, a first static pressure chamber 30 is formed between the negative-pressure fan 26 and the heat exchange device 28, a second static pressure chamber 31 is formed between the liquid atomization device 29 and the heat exchange device 28, the negative-pressure fan 26 forms a negative-pressure environment in the second static pressure chamber 31, and the liquid atomization device 29 sprays the atomized liquid into the second static pressure chamber 31 to evaporate the atomized liquid into vapor.

Referring to FIG. 9, the flash-evaporation condenser includes a pressure regulating device 32, a gas inlet of the pressure regulating device 32 is arranged outside the housing 27, an air outlet of the pressure regulating device is arranged inside the housing 27, a regulating air flow is sent into the housing 27 by means of the pressure regulating device 32 to promote the flow of the vapor in the housing 27 and form an aerosol in the housing 27.

Referring to FIG. 10, the pressure regulating device 32 may be one or more fans, the one or more fans are arranged close to the liquid atomization device 29, and the rotation of the one or more fans promotes the flow of the vapor and the atomized liquid in the housing 27.

Figure 11:
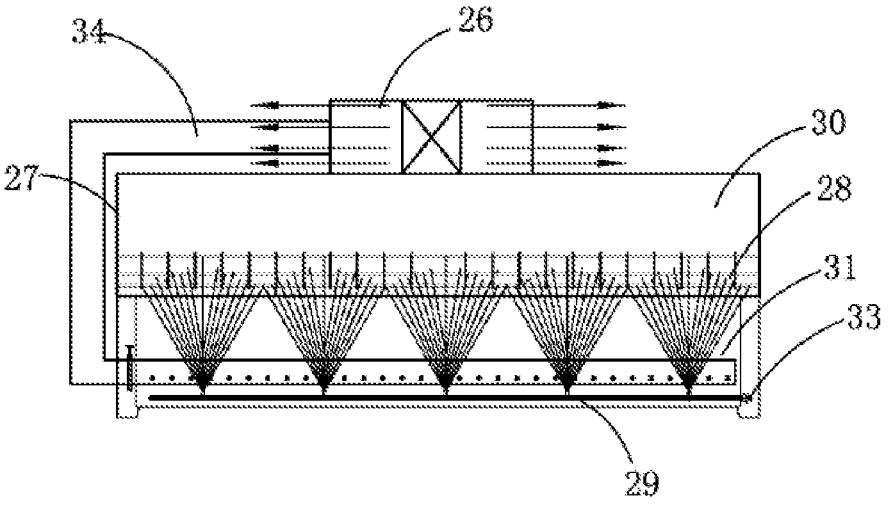
FIG. 11 is a schematic structural view of a third scheme of the flash-evaporation condenser.

Referring to FIG. 11, the negative-pressure fan 26 is connected to the housing 27 through a vapor circulation pipeline 34. Thus, part of the vapor is reused, and the introduced part of vapor replaces a small amount of external wind as a dispersion medium to suspend the atomized small water droplets (a dispersion phase) to form an aerosol environment. This example proves that the flash-evaporation condenser can still operate without introducing external wind, that is, the influence of the temperature and humidity of the external environment on the flash-evaporation condenser is completely eliminated.

Specifically, the liquid atomization device 29 includes a liquid supply pipeline, the liquid supply pipeline is arranged at the bottom of the housing 27, and is in communication with a liquid tank or a liquid pipe outside the housing 27, to continuously supply liquid into housing 27. The liquid supply pipeline may be a single linear pipeline, or two or more pipelines arranged side by side, or a single pipeline arranged in a coil shape. Multiple high-pressure atomization nozzles are distributed on the liquid supply pipeline, and the liquid in the liquid supply pipeline can be sprayed through the multiple high-pressure atomization nozzles to form a mist-like atomized liquid, which is dispersed in the accommodating chamber. Alternatively, the multiple high-pressure atomization nozzles may be replaced with an ultrasonic atomizer to form an atomized liquid. In one embodiment, the multiple high-pressure atomization nozzles are arranged toward a direction where the heat exchange device 28 is located, so that the atomized water can be better sprayed to the heat exchange device 28. Alternatively, the high-pressure atomizing nozzle can also be replaced with an ultrasonic atomizer to form an atomized liquid.

The liquid in the present application is In one embodiment water, which is economical and cost-effective. The following is illustrated with water as an example. The liquid atomization device 29 includes a water replenishing device 33, In one embodiment a softened water replenishing device, which can remove inorganic salts such as calcium and magnesium. The water processed by the softened water replenishing device has no external impurities, which avoids the scaling of the condenser tube to the greatest extent and increases the service life of the condenser tube. The liquid atomization device 29 atomizes each drop of water into a droplet of about 1/500 of an original water drop volume, to form micro or nanometer water mist, which increases a contact area with the air and accelerates the evaporation velocity by more than 300 times. The heat absorbed by the refined water droplets from liquid to gas is about 540 times the heat absorbed by the water when the water is heated by 1 degree Celsius, which can absorb a large amount of heat and greatly enhance the heat exchange effect.

Except the pressure regulating device 32, the housing 27 is in a closed state, and the environment in the housing 27 can be maintained in a stable low-temperature state, and the temperature is lower than a liquefaction critical temperature of the carbon dioxide. The basic cooling principle of the flash-evaporation closed condenser is that: in a closed environment, the water is promoted to evaporate from liquid to gas, to release cold capacity. The main factors promoting the evaporation of water are as follows: (1), the larger the surface area of water is, more easily the water evaporates; (2) the greater the negative-pressure value of the environment is, more easily water molecules separate from each other to form vapor; (3) the higher the temperature is, the faster the evaporation of water is.

Based on the above cooling principle, the specific scheme for the flash-evaporation closed condenser to promote the evaporation of water from liquid to gas is as follows.

First, the water atomization device atomizes the water into small mist droplets, which greatly increases a surface area of the mist-droplet water and can accelerate the evaporation. In addition, the mist-droplet water moves actively and can float around in the housing 27, which accelerates the heat exchange and evaporation.

Second, the housing 27 cooperates with the negative-pressure fan 26, so that the second static pressure chamber 31 and the first static pressure chamber 30 in the housing 27 always maintain a negative-pressure environment, and a pressure in the second static pressure chamber 31 is lower than an ambient atmospheric pressure by more than 20 Pa. In this case, the water molecules on the surface of the atomized small mist droplet are more likely to depart from the mist droplet body and transform into vapor. The ambient atmospheric pressure here refers to the ambient atmospheric pressure value of the working environment where the flash-evaporation closed condenser is located.

Third, the carbon dioxide refrigerant flowing into the condenser 11 absorbs the cold capacity and release heat in the housing 27 to complete the heat exchange. At this time, the condenser 11 generates radiant heat. Therefore, when the mist droplets approach the condenser 11, the evaporation may be accelerated under the action of the radiant heat, and the heat of the carbon dioxide refrigerant may be further absorbed to cool the carbon dioxide refrigerant down.

In addition, when the small mist droplets that have not completely evaporated into vapor pass through the condenser 11, the small mist droplets can also exchange heat by directly contacting the condenser 11, to achieve the effect of auxiliary cooling and refrigeration. Since the volume of the water atomized into mist droplets becomes smaller, it is easier to disperse and float, which speeds up the fluidity of the mist droplets and can quickly complete heat exchange with the condenser 11. In addition, most of the mist droplets with small volume in the direct-contact heat exchange process absorb heat and evaporate into vapor, which greatly improves the refrigeration efficiency.

It should be particularly noted that, unlike an existing air-cooled heat exchanger, the housing 27 used in the flash-evaporation closed condenser is closed, and the housing 27 is configured to prevent outdoor wind from entering the housing 27 and prevent excessive outdoor wind from entering the housing 27, which affects the evaporation of the atomized water in the housing 27. On the contrary, the existing air-cooled heat exchanger exchanges heat and refrigerates by means of air flowing through the condenser 11 in the air-cooled heat exchanger. Therefore, the larger the air amount entering the housing 27 is, the better the refrigeration effect of the air-cooled heat exchanger is.

It should be supplemented that the above housing 27 is not equivalent to a completely sealed housing 27. In actual production, there may be gaps between plates or between plates and components. When the negative-pressure fan 26 exhausts outward, the air in the external environment may enter the housing 27 through the gaps. Such small amount of air intake may not affect the overall negative-pressure environment in the housing 27. By regulating a rotation speed of the negative-pressure fan 26 or the pressure regulating device 32, the negative-pressure environment in the housing 27 can be kept at a relatively stable pressure, which may not affect the evaporation effect of the atomized water, that is, may not affect the refrigeration effect of the flash-evaporation closed condenser.

By promoting the evaporation of the atomized water in the closed negative-pressure environment, the flash-evaporation closed condenser lowers the overall temperature in the housing 27 to below the liquefaction critical temperature of the carbon dioxide, which promotes the liquefaction of the carbon dioxide and improves the refrigeration efficiency of the system.

Specifically, the solution of the flash-evaporation closed condenser as shown in FIG. 9 includes a housing 27. The housing 27 is rectangular and defined by plates, and an accommodating chamber is formed inside. The water atomization device is provided at the bottom of the accommodating chamber, the negative-pressure fan 26 is provided at the top of the accommodating chamber, and the heat exchange device 28 is provided in the middle of the accommodating chamber. The heat exchange device 28 is arranged between the water atomization device and the negative-pressure fan 26. In one embodiment, the heat exchange device 28 is a coil-type condensing tube, and the carbon dioxide refrigerant is cooled and condensed by means of the coil-type condensing tube.

The second static pressure chamber 31 is formed between the heat exchange device 28 and the water atomization device, and the first static pressure chamber 30 is formed between the heat exchange device 28 and the negative-pressure fan 26. The negative-pressure fan 26 continuously discharges the gas in the housing 27 out of the housing 27, so that a uniform and stable negative-pressure environment is formed in the second static pressure chamber 31 and the first static pressure chamber 30.

The water atomization device sprays the atomized water into the second static pressure chamber 31, and the atomized water quickly evaporates in the negative-pressure environment of the second static pressure chamber 31, transforms from water-mist phase into vapor and absorbs heat, which lowers the ambient temperature in the housing 27. The carbon dioxide refrigerant in the heat exchange device 28 absorbs cold capacity when passing through the low-temperature environment in the housing 27, which lowers the temperature of the carbon dioxide refrigerant.

Since it is also a negative-pressure environment in the first static pressure chamber 30, the vapor evaporated in the second static pressure chamber 31 may enter the first static pressure chamber 30 through the heat exchange device 28, and then be discharged out of the housing 27 through the negative-pressure fan 26. Thus, the atomized water in the second static pressure chamber 31 continuously evaporates into vapor, and releases cold capacity, and the vapor is continuously discharged out of the housing 27 through the negative-pressure fan 26 to complete refrigeration.

Further, the pressure regulating device 32 can promote the flow of the vapor and the atomized water in the housing 27. Specifically, the pressure regulating device 32 includes a slender pipe, which is arranged close to the water atomization device. A first end of the pipe is a closed end, which extends into the second static pressure chamber 31. A second end of the pipe is an open end, which is located outside the housing 27. In a portion of the pipe located inside the second static pressure chamber 31, multiple air outlets are distributed on a pipe wall. While the flash-evaporation closed condenser is working, a small amount of outdoor air can enter the pipe through the second end of the pipe, and blow to the water atomization device through the multiple air outlets, to accelerate the flow of the atomized water and the vapor in the second static pressure chamber 31 and promote the evaporation of the atomized water and the discharge of the vapor.

A sealing cover is provided at the open end of the second end of the pipe. When there is no need to promote the flow of the atomized water and the vapor in the second static pressure chamber 31, the sealing cover may be added to block entry of air, and the pressure regulating device 32 is closed. Besides, the sealing degree of the sealing cover may be adjusted, to control the entry amount of air, thus adjusting the flow degree of the atomized water and the vapor in the second static pressure chamber 31.

It should be supplemented that, based on the above basic refrigeration principle of the flash-evaporation closed condenser, the housing 27 is required to prevent natural wind from entering into the housing 27, which does not conflict with the pressure regulating device 32. First, though the pressure regulating device 32 allows the external natural wind to enter the housing 27, an amount of the entry air is very small, which is similar to the above natural wind entering through the gap between plates of the housing 27, and will not affect the normal operation of the device. Second, the pressure regulating device 32 is arranged to promote the flow of the atomized water and the vapor after the water evaporation through the movement of micro air flow, which accelerates the vapor moving from the second static pressure chamber 31 to the first static pressure chamber 30 and promotes the discharge of the vapor on one hand, and promotes the evaporation of the atomized water on the other hand. In other words, the small amount of natural wind entering the housing 27 through the pressure regulating device 32 cannot achieve the effect of cooling the condenser 11, which is essentially different from the existing air-cooled heat exchanger.

The flash-evaporation condenser has the following technical effects.

(1), by promoting the evaporation of the atomized liquid in the closed negative-pressure environment, the overall temperature in the closed environment is lowered. The heat exchange device 28 can achieve the refrigeration effect through radiation in a low-temperature environment, which is not affected by the temperature and humidity of external natural wind, and can be used in various areas with different environments.

In the negative-pressure environment, the small particles of the atomized water are dispersed and suspended in the gas medium to form a colloidal dispersion system, forming the aerosol. Since the dispersion medium of the aerosol is gas with a small viscosity, the density difference between the dispersed phase and the dispersion medium is large, the particles are extremely easy to bond when they collide, and further due to the volatilization of the liquid particles, the aerosol has its unique regularity. The aerosol particles have a considerable specific surface and surface energy, which can evaporate the liquefied water quickly and improve the refrigeration effect. In practical application, considering that the external wind is easy to obtain, a small amount of wind is introduced as the gas medium for the suspension of the small particles of the atomized water. In order to verify that the flash-evaporation condenser is not affected by the temperature and humidity of a small amount of air entering from the outside, part of the vapor may be introduced from an outlet of the negative-pressure fan as a gas medium, as shown in FIG. 11.

The atomized water generated by the water atomization device flash-evaporates quickly in the negative-pressure environment of the accommodating chamber, transforms from water-mist phase into vapor, and absorbs heat, reducing the ambient temperature in the housing 27. The vapor flash-evaporated from the atomized water can be discharged out of the housing 27 through the negative-pressure fan 26. Therefore, the atomized water in the accommodating chamber continuously evaporates into vapor and releases cold capacity. The vapor is continuously discharged out of the housing 27 through the negative-pressure fan 26 to complete refrigeration. The low-temperature environment in the housing 27 can be used to cool and lower the temperature of a substance.

(2), since convection heat exchange with the external environment is not required in the refrigeration process, the flash-evaporation closed condenser according to the present application has a small installed capacity, and the entire equipment occupies a small space, which is convenient for mounting and saves space.

(3), the flash-evaporation closed condenser according to the present application realizes refrigeration completely through the evaporation of the atomized water. The process of water transforming from liquid to gas can release the cold capacity for refrigeration, and the temperature of the vapor discharged by the equipment may not rise. Therefore, in the refrigeration process, there is actually no heat discharged into the atmosphere and heat island effect will not be formed. The refrigeration system has a high refrigeration efficiency, and a stable and reliable refrigeration effect.

Third Embodiment

Figure 16:
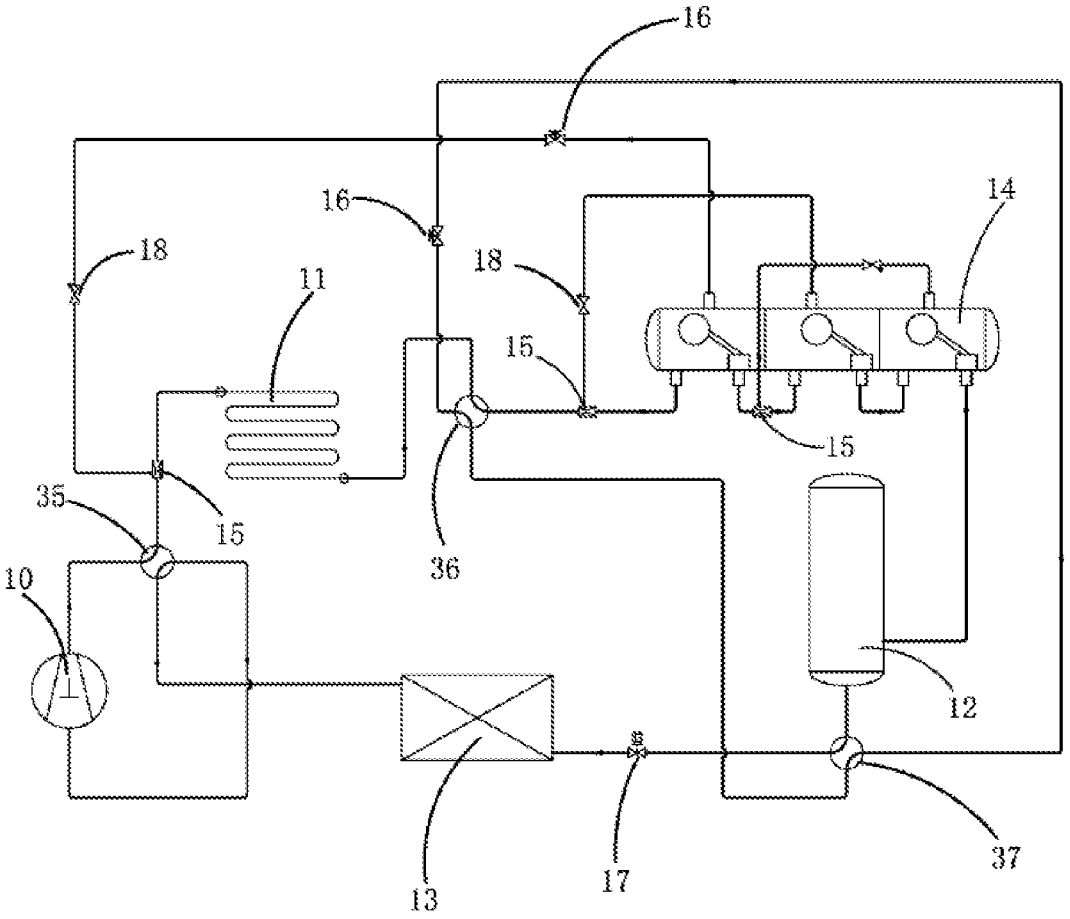
FIG. 16 is a schematic structural view of the carbon dioxide refrigeration system according to the present application in the refrigeration mode.
Figure 17:
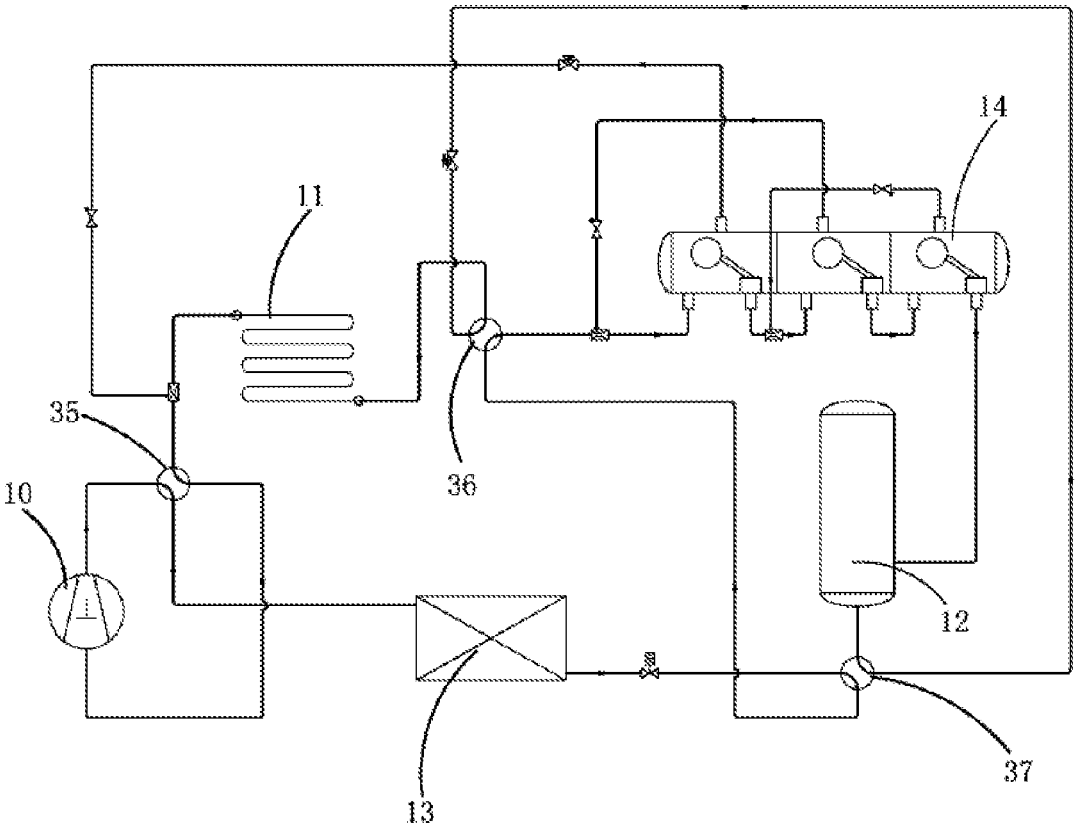
FIG. 17 is a schematic structural view of the carbon dioxide refrigeration system according to the present application in the heating mode.

The content of this embodiment includes the technical solutions of the first and second embodiments. On the basis of the first and second embodiments, this embodiment realizes refrigeration with the carbon dioxide medium, and also can be switched to a heating mode by means of a four-way reversing valve, as shown in FIGS. 16 and 17. The carbon dioxide refrigeration system includes a first four-way reversing valve 35, a second four-way reversing valve 36 and a third four-way reversing valve 37; wherein four outlets of the first four-way reversing valve 35 are respectively connected to an inlet of the condenser 11, an inlet of the compressor 10, an outlet of the compressor 10 and an outlet of the evaporator 13 through a gas pipeline; two outlets of the second four-way reversing valve 36 are respectively connected to an outlet of the condenser 11 and an inlet of the gas-liquid separator 14 (or an inlet of the liquid reservoir 12) through the gas pipeline, and the other two outlets of the second four-way reversing valve are respectively connected to two outlets of the third four-way reversing valve 37; two outlets of the third four-way reversing valve 37 are respectively connected to an outlet of the liquid reservoir 12 and an inlet of the evaporator 13, and the other two outlet of the third four-way reversing valve are respectively connected to the other two outlets of the second four-way reversing valve 36.

FIG. 16 is a schematic diagram showing a flow direction of carbon dioxide in a refrigeration mode. In the refrigeration mode, the first four-way reversing valve 35 communicates the outlet of the compressor 10 with the inlet of the condenser 11, and communicates the outlet of the evaporator 13 with the inlet of the compressor 10; the second four-way reversing valve 36 communicates the outlet of the condenser 11 with the inlet of the gas-liquid separator 14 (or the inlet of the liquid reservoir 12), and other two outlet of the second four-way reversing valve communicate with the third four-way reversing valve 37; the third four-way reversing valve 37 communicates the outlet of the liquid reservoir 12 with the inlet of the evaporator 13, and other two outlet of the third four-way reversing valve communicate with the second four-way reversing valve 36.

FIG. 17 is a schematic diagram showing a flow direction of carbon dioxide in a heating mode. In the heating mode, the first four-way reversing valve 35 communicates the outlet of the compressor 10 with the evaporator 13, and communicates the inlet of the condenser 11 with the inlet of the compressor 10; the second four-way reversing valve 36 communicates the outlet of the condenser 11 with the third four-way reversing valve 37, and communicates the third four-way reversing valve 37 with the inlet of the gas-liquid separator 14 (or the inlet of the liquid reservoir 12); the third four-way reversing valve 37 communicates the outlet of the liquid reservoir 12 with the second four-way reversing valve 36, and communicates the evaporator 13 with the second four-way reversing valve 36.

Figure 12:
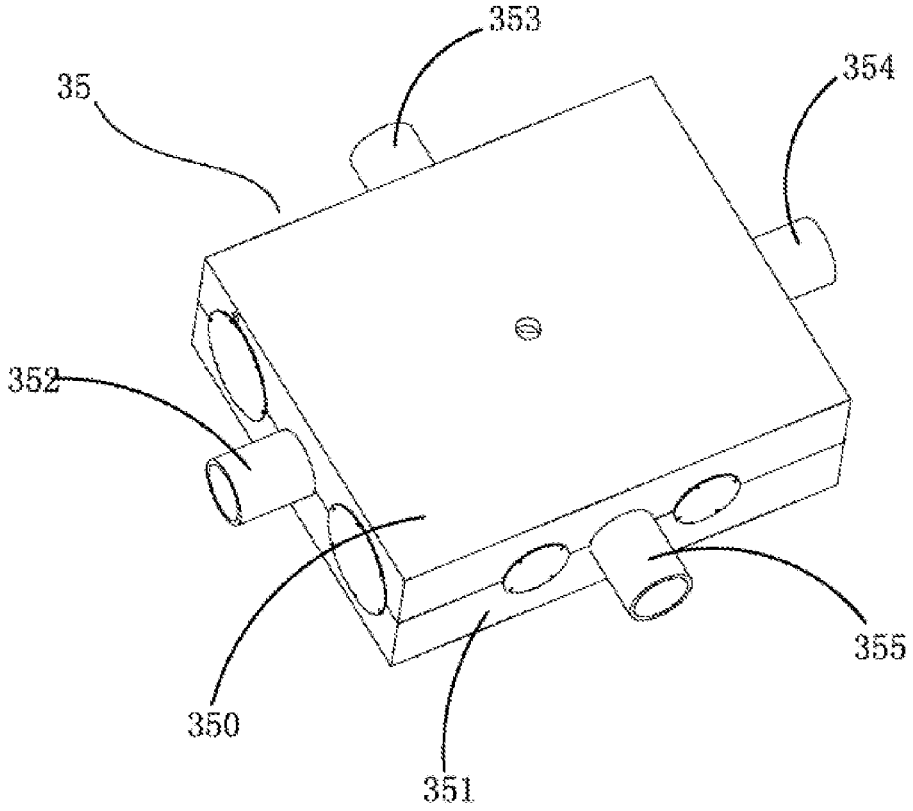
FIG. 12 is a schematic perspective view of a high-pressure four-way reversing valve.
Figure 13:
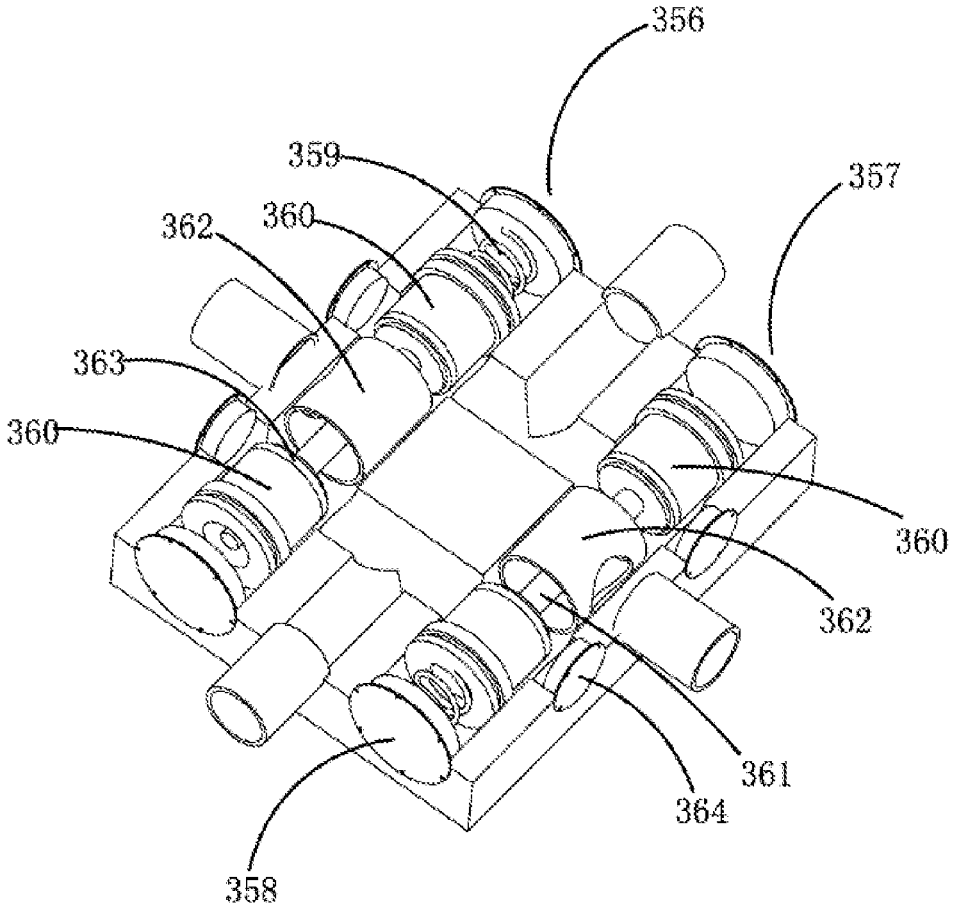
FIG. 13 is a schematic internal structural view of the high-pressure four-way reversing valve.

Due to the high pressure characteristic of the carbon dioxide, the existing four-way reversing valve bears a limited pressure and is not suitable for the carbon dioxide refrigeration system. Therefore, it is necessary to design a four-way reversing valve capable of adapting to a carbon dioxide refrigeration system with a large pressure difference. Referring to FIG. 12 and FIG. 13, the four-way reversing valve includes a valve body, a first outlet 352, a second outlet 353, a third outlet 354 and a fourth outlet 355 are defined on the valve body, a gas passage is defined inside the valve body, the gas passage communicates the first outlet 352, the second outlet 353, the third outlet 354 and the fourth outlet 355, the valve body includes an upper sealing plate 350 and a lower sealing plate 351 cooperating with each other, and is convenient for assembly and maintenance. A valve cover 364 is provided on the valve body, which can be opened to observe an interior of the four-way reversing valve.

A first valve core assembly 356 and a second valve core assembly 357 are provided in the valve body, and the first valve core assembly 356 and the second valve core assembly 357 are movable inside the valve body to switch a communication relationship between the outlets; and the valve core assemblies can be moved by a spring fixing base 358. Each of the first valve core assembly and the second valve core assembly includes a spring 359, two valve cores 360, a screw rod 361, a valve tube 362 and a shaft sleeve 363, wherein two ends of the screw rod 361 are respectively connected to the two valve cores 360, one end of the spring 359 is connected to one of the two valve cores 360, and another end of the spring is connected to the spring fixing base 358, the valve tube 362 is sleeved on the screw rod 361, a side of the valve tube 362 facing the outlet has an open structure, the open structure allows gas to enter an interior of the four-way reversing valve, the shaft sleeve 363 is arranged on the valve core 360, and the shaft sleeve 363 cooperates with the valve tube 362 to prevent carbon dioxide gas from passing through, which plays a sealing role.

Figure 14:
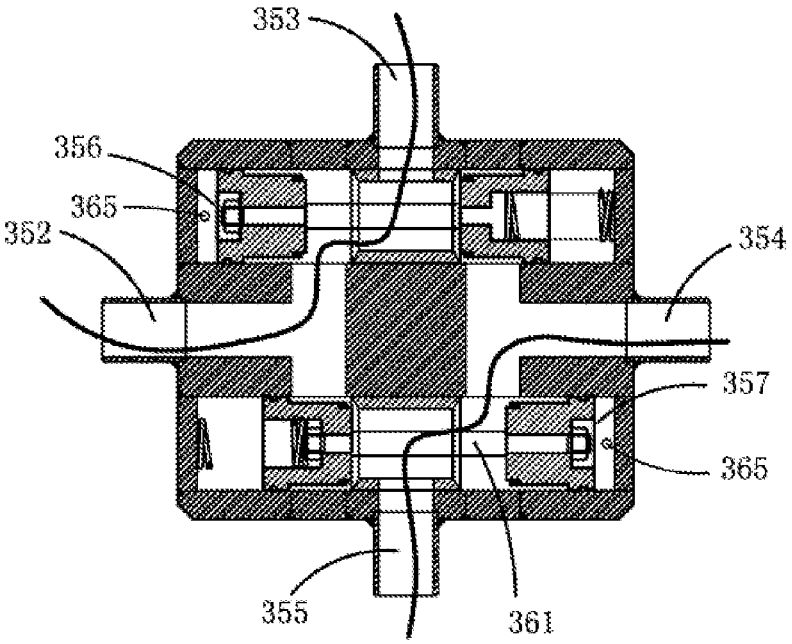
FIG. 14 is a schematic sectional view of the four-way reversing valve in a heating mode.
Figure 15:
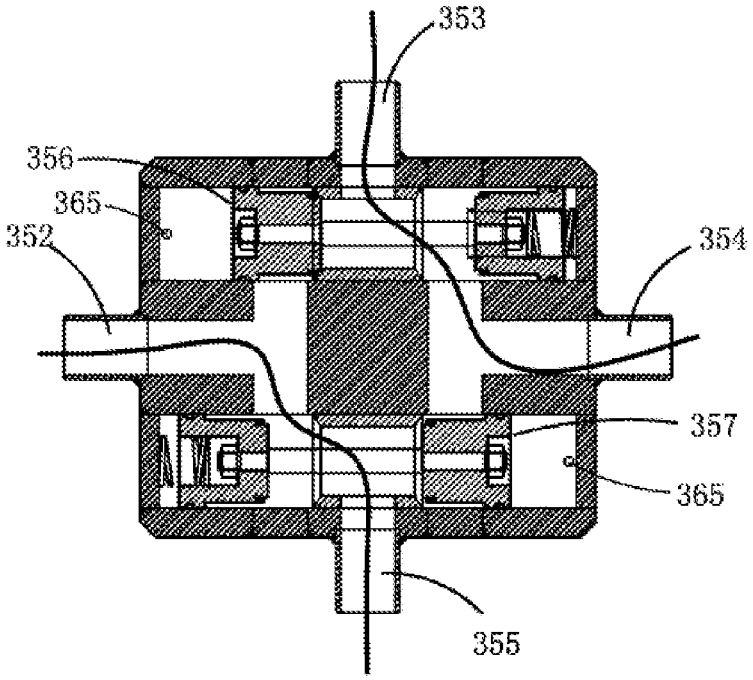
FIG. 15 is a schematic sectional view of the four-way reversing valve in a refrigeration mode.

The valve body includes a power gas source inlet 365, the power gas source inlet 365 is connected to a high-pressure power gas source (not shown), and the valve core assemblies are pushed to move through the cooperation of the change of gas pressure and the spring, to switch a communication relationship between the outlets. The switching of cooling and heating functions is realized by an on-off of the high-pressure power gas source. The high-pressure gas power is a small branch gas drawn from the outlet of the compressor. This small branch gas pipe is provided with a solenoid valve, and is divided into two branches behind the solenoid valve and connected to the power gas source inlet 365 at the upper sealing plate 350. Referring to FIG. 14, the heating is achieved when the first valve core assembly 356 is drawn to the left and the second valve core assembly 357 is drawn to the right. Referring to FIG. 15, during refrigeration, the solenoid valve mounted on the small branch gas pipe is electrically opened, and in a case that a pressure of the introduced gas source is larger than a spring force, the refrigeration is achieved when the first valve core assembly 356 is drawn to the right and the second valve core assembly 357 is drawn to the left. The whole switching process is simple and reliable.

The carbon dioxide refrigeration system is used as an air conditioner configured to adjust indoor temperature, or a cold source of a cold storage or quick freezing storage.

Fourth Embodiment

Figure 20:
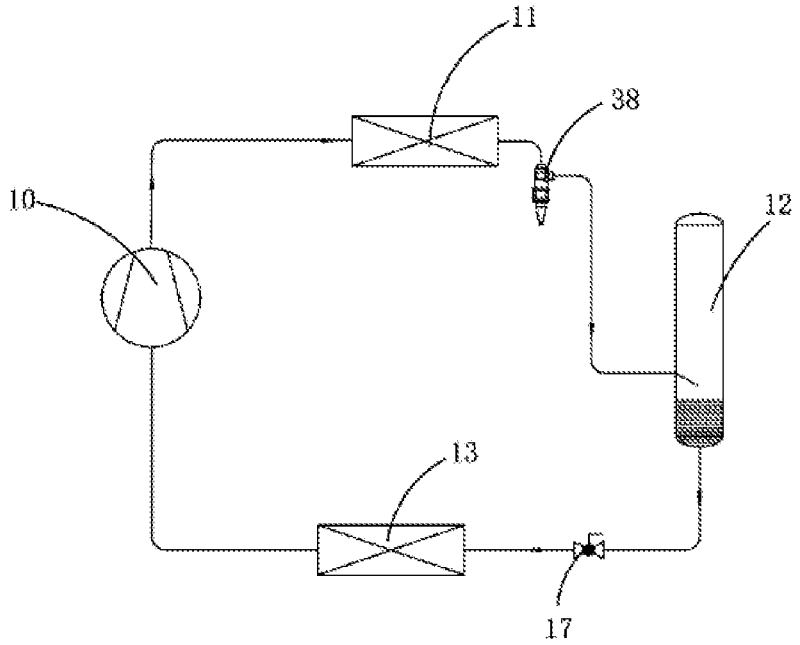
FIG. 20 is a schematic structural view of the carbon dioxide refrigeration system with an overflow differential pressure valve according to the present application.
Figure 22:
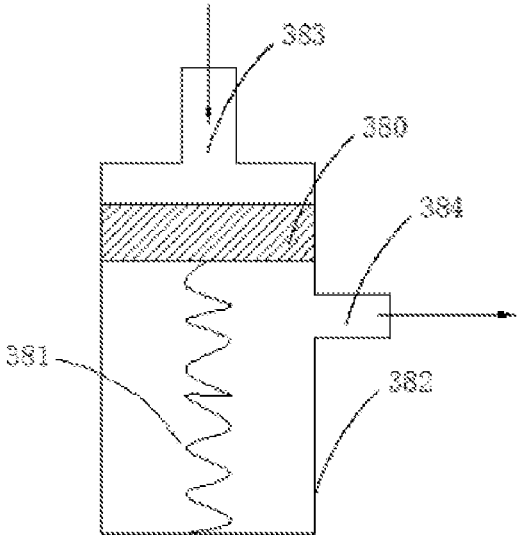
FIG. 22 is a schematic structural view of the overflow differential pressure valve.
Figure 23:
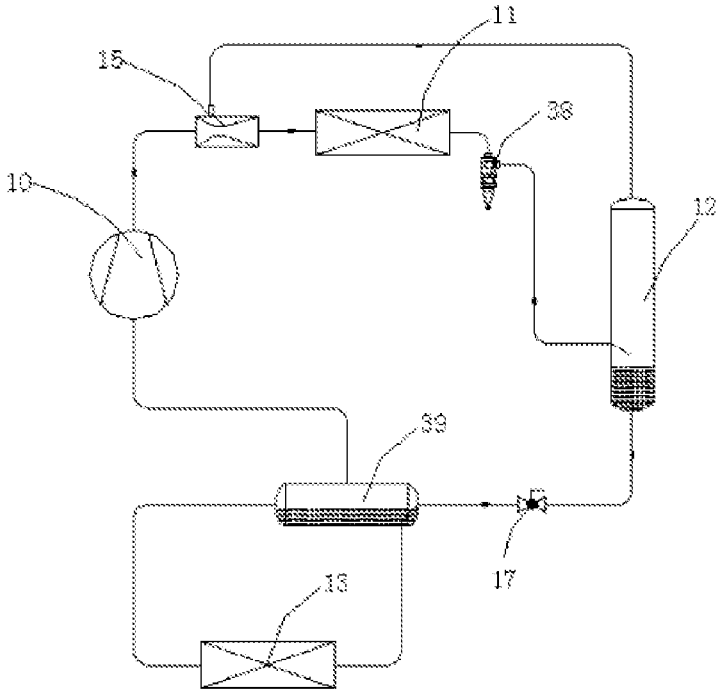
FIG. 23 is a schematic structural view of the carbon dioxide refrigeration system with a low-pressure circulation barrel according to the present application.

On the basis of the above embodiments, referring to FIG. 20, a single-stage carbon dioxide refrigeration system including an overflow differential pressure valve is provided by this embodiment, which includes an evaporator 13, a compressor 10, a condenser 11 and a liquid reservoir 12 connected in a listed sequence. In view of the fact that a condensing pressure in the condenser 11 may be too low or too high, it is necessary to control a pressure difference and a condensing pressure. In this embodiment, an overflow differential pressure valve 38 is arranged between the condenser 11 and the liquid reservoir 12, as shown in FIG. 22. The overflow differential pressure valve 38 includes a differential pressure valve housing 382, a sealing gasket 380, a differential pressure valve inlet 383 and a differential pressure valve outlet 384. The differential pressure valve inlet 383 is in communication with the outlet of the condenser 11, and the differential pressure valve outlet 384 is in communication with the liquid reservoir 12. The sealing gasket 380 is arranged in a chamber formed inside the differential pressure valve housing 382, the differential pressure valve inlet 383 and the differential pressure valve outlet 384 are both in communication with the chamber formed inside the differential pressure valve housing 382, and the sealing gasket 380 is movable in the differential pressure valve housing 382 according to a pressure change to realize the communication or occlusion between the differential pressure valve inlet 383 and the differential pressure valve outlet 384.

Specifically, the overflow differential pressure valve 38 further includes a differential pressure valve spring 381, wherein one end of the differential pressure valve spring 381 is connected to the sealing gasket 380, another end of the differential pressure valve spring is fixed on the differential pressure valve housing 382, a shape of the sealing gasket 380 matches a sectional shape of the chamber formed inside the differential pressure valve housing 382, and the sealing gasket 380 moves back and forth with the compression or release of the differential pressure valve spring 381. A relative position of the sealing gasket 380 and the differential pressure valve spring 381 determines a differential pressure value of the carbon dioxide liquid coming out of the condenser 11. In a case that the pressure difference changes, a force balance of the differential pressure valve spring 381 is broken, which drives the sealing gasket 380 to move and controls the controlled differential pressure value to be a set value.

In a case that the pressure of the condenser 11 is too low, a pressure on a side of the differential pressure valve inlet 383 of the overflow differential pressure valve 38 is relatively low. At this time, the resistance received by the sealing gasket 380 and the differential pressure valve spring 381 in the overflow differential pressure valve 38 is small, and the differential pressure valve spring 381 is released, so that the sealing gasket 380 is located between the inlet 383 and the outlet 384 of the overflow differential pressure valve 38, that is, the overflow differential pressure valve 38 is in a closed state. When the overflow differential pressure valve 38 is closed, the carbon dioxide refrigerant in the condenser 11 cannot be discharged through the overflow differential pressure valve 38, which may increase the pressure in the condenser 11, to increase the condensing pressure in the condenser 11.

In a case that the pressure in the condenser 11 gradually increases, the pressure received by the sealing gasket 380 and the differential pressure valve spring 381 in the overflow differential pressure valve 38 gradually increases as well. At this time, the differential pressure valve spring 381 is gradually compressed, and the sealing gasket 380 gradually moves to a lower portion of the overflow differential pressure valve 38. In a case that the pressure in the condenser 11 rises to a condensing pressure suitable for operation (higher than the evaporation pressure by 30 Kg/cm2 to 40 Kg/cm2), the sealing gasket 380 moves to the lower portion of the outlet 384 of the overflow differential pressure valve 38, so that the inlet 383 is in communication with the outlet 384 of the overflow differential pressure valve 38. At this time the overflow differential pressure valve 38 is in an open state, and the carbon dioxide refrigerant can be discharged through the outlet 384 of the overflow differential pressure valve 38 and enter the liquid reservoir 12.

As the carbon dioxide refrigerant is discharged through the overflow differential pressure valve 38, the condensing pressure in the condenser 11 gradually decreases. In a case that the condensing pressure is too low, the sealing gasket 380 is pushed by the differential pressure valve spring 381 to move to an upper portion of the outlet 384 of the overflow differential pressure valve 38 again, so that the overflow differential pressure valve 38 is closed. The above process is cycled, so that the pressure in the condenser 11 is kept in an appropriate range at all times, which ensures the efficient operation of the condenser 11.

It should be particularly noted that the existing carbon dioxide refrigeration system has unideal condensation effect of the carbon dioxide due to the insufficient condensation efficiency of the condenser 11, and the condensing pressure in the condenser 11 is often too high. In order to detect and control the condensing pressure, different from the existing carbon dioxide refrigeration system, this embodiment In one embodiment uses a mechanical overflow differential pressure valve 38. The condensing pressure of the condenser 11 is controlled and adjusted by the mechanical overflow differential pressure valve 38, to keep the condensing pressure in an appropriate range. The mechanical overflow differential pressure valve 38 has a simple structure, low cost, easy maintenance, and can ensure the safe and efficient operation of the single-stage carbon dioxide refrigeration system according to the present application. The mechanical overflow differential pressure valve 38 can adjust the condensing pressure in the condenser 11, to keep the condensing pressure in an appropriate range and ensure the normal operation of the system. In addition, the mechanical overflow differential pressure valve 38 has a certain throttling effect, which can lower the pressure of the carbon dioxide in stages and ensure the safe and efficient operation of the system.

Figure 21:
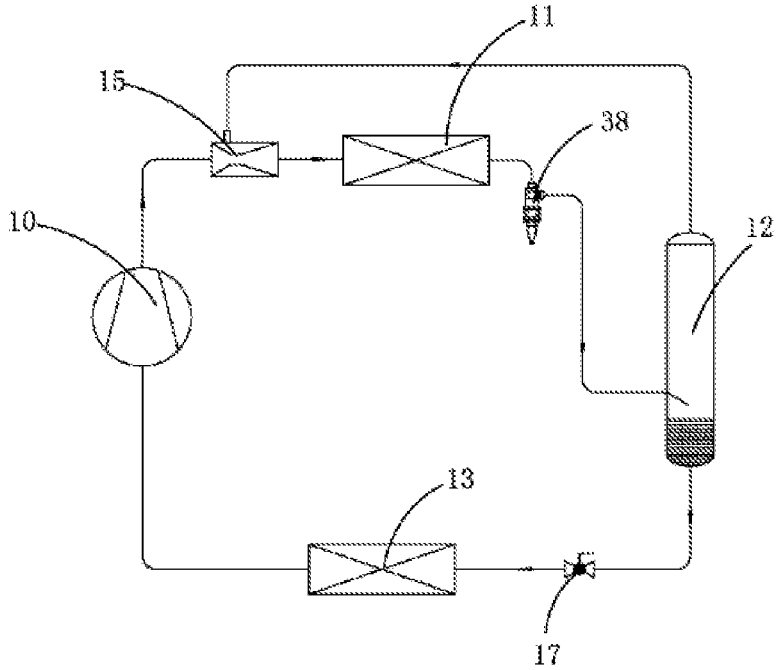
FIG. 21 is a schematic structural view of the carbon dioxide refrigeration system with the overflow differential pressure valve and the venturi tube according to the present application.

Referring to FIG. 21, the refrigeration system of this embodiment further includes a suction assembly 15. The suction assembly 15 is a venturi tube, and the structure of the venturi tube is the same as the structure of the first embodiment.

If liquid refrigerant is present in the compressor 10 that rotates at a high speed, the compressor 10 will be severely damaged. Therefore, in order to ensure safe operation, a conventional direct expansion refrigeration system generally controls the flow of the refrigerant entering the evaporator 13 by adjusting an opening degree of an expansion valve 17, so that the refrigerant is completely gasified in the evaporator 13. However, this liquid supply method cannot make full use of the heat exchange area of the evaporator 13, which affects the refrigeration efficiency of the system.

Specifically, as shown in FIG. 22, the carbon dioxide refrigeration system of this embodiment includes a low-pressure circulation barrel 39, wherein a liquid outlet of the low-pressure circulation barrel 39 is in communication with an inlet end of the evaporator 13, an outlet end of the evaporator 13 is in communication the low-pressure circulation barrel 39, and a gas outlet of the low-pressure circulation barrel 39 is in communication with the compressor 10. The regulating expansion valve 17 is arranged between the low-pressure circulation barrel 39 and the liquid reservoir 12. With such arrangement, the opening degree of the regulating expansion valve 17 may be adjusted and the flow of the carbon dioxide liquid may be increased, so that a part of the low-temperature liquid that is not completely evaporated still remains at the outlet end of the evaporator 13. Thus, the heat exchange area of the evaporator 13 can be fully utilized. The part of the carbon dioxide liquid that is not completely evaporated is temporarily stored in the low-pressure circulation barrel 39 and will not enter the compressor 10, which not only makes full use of the heat exchange area of the evaporator 13, but also ensures the safe operation of the system. In addition, a liquid level gauge (not shown in the figure) may be provided in the low-pressure circulation barrel 39, which is configured to measure a liquid level of the carbon dioxide liquid in the low-pressure circulation barrel 39.

The working process of the refrigerant circulation system is described in detail below with reference to the above description: the opening degree of the expansion valve 17 is adjusted, the flow of the carbon dioxide liquid is increased, and the heat exchange area in the evaporator 13 is fully utilized. At this time, low-pressure carbon dioxide gas and low-pressure carbon dioxide liquid that is not completely evaporated flow out through the outlet end of the evaporator 13. The carbon dioxide gas-liquid mixture flowing out of the outlet end of the evaporator 13 enters the low-pressure circulation barrel 39 to complete the gas-liquid separation. The gaseous carbon dioxide refrigerant is sucked out by the compressor 10, and the liquid carbon dioxide refrigerant is temporarily stored in the low-pressure circulation barrel 39. When the liquid carbon dioxide refrigerant in the low-pressure circulation barrel 39 accumulates to a certain amount, the liquid level gauge reaches a set upper limit, and the supply of the liquid carbon dioxide is reduced or suspended.

The structure of the low-pressure circulation barrel 39 can make full use of the heat exchange area of the evaporator 13, which enhances the heat exchange effect, improves the refrigeration efficiency of the system, and ensures the safe operation of the system. In addition, the structure of the refrigerant circulation system is simple, convenient to control, and the operation is stable and reliable.

In the description of the present application, it should be noted that the orientation or positional relationships indicated by terms such as "front/back", "up/down", "left/right", "vertical/horizontal", "inner/outer" and the like are based on the orientation or positional relationships shown in the drawings, and are merely for the convenience of describing the present application and the simplification of the description, and do not indicate or imply that the device or element referred to must have a particular orientation, or be configured and operated in a particular orientation, and therefore should not be construed as a limitation to the scope of the present application. In addition, terms such as "first", "second", "third" and the like are merely for description, and should not be construed as indicating or implying relative importance. For the convenience of description, the "left", "right", "up" and "down" referred to below are consistent with the left, right, up, and down directions of the drawings, but they do not limit the structure of the present application.

In the description of the present application, it should be noted that, unless otherwise explicitly specified and defined, terms such as "installation", "link", "connection", "communication" should be understood in a broad sense, for example, the terms may imply a fixed connection, a detachable connection, or an integral connection; a mechanical connection or an electrical connection; a direct connection, an indirect connection through an intermediate medium, or an internal communication between two components. For those skilled in the art, the specific meaning of the above terms in the present application may be understood in the light of specific circumstances.

Finally, it should be noted that, the above embodiments are only used for illustration of the technical solutions of the present application rather than limitation to the protection scope of the present application. Although the present application has been illustrated in detail with reference to the preferred embodiments, it should be understood by those skilled in the art that, modifications or equivalent replacements may be made to the technical solutions of the present application without departing from the essence and scope of the present application.

The invention claimed is:

1. A carbon dioxide refrigeration system comprising a compressor, a condenser, a liquid reservoir and an evaporator which are connected in a listed sequence; wherein, a suction assembly is arranged between the compressor and the condenser, the suction assembly is in communication with the liquid reservoir or a gas-liquid separator, the gas-liquid separator is arranged between the condenser and the liquid reservoir, and the suction assembly is configured to suck carbon dioxide gas in the liquid reservoir or the gas-liquid separator back into a pipeline between the compressor and the condenser, wherein the condenser is a flash-evaporation condenser, the flash-evaporation condenser comprises a closed housing, a negative-pressure fan, a heat exchange device and a liquid atomization device, wherein the negative-pressure fan is arranged on the housing, the negative-pressure fan is configured to form a negative-pressure environment inside the housing, the liquid atomization device and the heat exchange device are arranged in the housing, the liquid atomization device is configured to spray an atomized liquid into an accommodating chamber of the housing, and the atomized liquid evaporates into vapor in the negative-pressure environment to completely condense and liquefy a carbon dioxide medium in the heat exchange device.

2. The carbon dioxide refrigeration system according to claim 1, wherein the suction assembly comprises a first port, a second port and a third port, the first port is in communication with the compressor, the second port is in communication with the condenser, and the third port is in communication with the liquid reservoir or the gas-liquid separator.

3. The carbon dioxide refrigeration system according to claim 1, wherein the suction assembly is a venturi tube or a venturi group with a plurality of venturi tubes connected in parallel, and the gas-liquid separator is a float valve or a float valve group with a plurality of float valves connected in series.

4. The carbon dioxide refrigeration system according to claim 2, wherein the suction assembly comprises a three-way valve and a negative-pressure pump, the negative-pressure pump is arranged on a pipeline communicating the third port with the liquid reservoir or the gas-liquid separator, and the negative-pressure pump is configured to generate a set negative pressure in the liquid reservoir or the gas-liquid separator.

5. The carbon dioxide refrigeration system according to claim 3, wherein the venturi tube comprises a constricted segment, a throat segment and a flaring segment which are connected in a listed sequence.

6. The carbon dioxide refrigeration system according to claim 3, wherein the float valve comprises two ports arranged at the bottom and one port arranged at the top.

7. The carbon dioxide refrigeration system according to claim 3, wherein the carbon dioxide refrigeration system comprises a first venturi tube and a first float valve, wherein the first venturi tube is arranged on the pipeline between the compressor and the condenser, the first float valve is arranged on a pipeline between the condenser and the liquid reservoir, and a throat segment connecting port of the first venturi tube is connected to the first float valve; or the carbon dioxide refrigeration system comprises a first venturi tube, a first float valve, a second venturi tube and a second float valve, wherein the first venturi tube is arranged on a pipeline between the compressor and the condenser, the first float valve and the second float valve are connected in series on a pipeline between the condenser and the liquid reservoir, a throat segment connecting port of the first venturi tube is connected to the first float valve, the second venturi tube is arranged between the first float valve and the condenser, and a throat segment connecting port of the second venturi tube is connected to the second float valve; or the carbon dioxide refrigeration system comprises a first venturi tube, a first float valve, a second venturi tube, a second float valve, a third venturi tube and a third float valve, wherein the first venturi tube is arranged on the pipeline between the compressor and the condenser, the first float valve, the second float valve and the third float valve are connected in series on a pipeline between the condenser and the liquid reservoir, a throat segment connecting port of the first venturi tube is connected to the first float valve, the second venturi tube is arranged between the first float valve and the condenser, a throat segment connecting port of the second venturi tube is connected to the second float valve; the third venturi tube is arranged between the first float valve and the second float valve, and a throat segment connecting port of the third venturi tube is connected to the third float valve; or the carbon dioxide refrigeration system comprises a first venturi tube, a first float valve, a second venturi tube, a second float valve and a third venturi tube, wherein the first venturi tube is arranged on the pipeline between the compressor and the condenser, the first float valve and the second float valve are connected in series on a pipeline between the condenser and the liquid reservoir, a throat segment connecting port of the first venturi tube is connected to the first float valve, the second venturi tube is arranged between the first float valve and the condenser, and a throat segment connecting port of the second venturi tube is connected to the second float valve; the third venturi tube is arranged between the first float valve and the second float valve, and a throat segment connecting port of the third venturi tube is connected to the liquid reservoir; or the carbon dioxide refrigeration system comprises one venturi tube and more than one float valves, the venturi tube is arranged on the pipeline between the compressor and the condenser, the more than one float valves are connected in series on a pipeline between the condenser and the liquid reservoir, and the more than one float valves are all connected to a throat segment connecting port of the venturi tube.

8. The carbon dioxide refrigeration system according to claim 1, wherein an exhaust amount of the negative-pressure fan is greater than an evaporation amount of the atomized liquid in the housing; and a pressure of a static pressure chamber in the housing is lower than an ambient atmospheric pressure by more than 20 Pa.

9. The carbon dioxide refrigeration system according to claim 1, wherein a condensing pressure in a condensing tube is not higher than a critical pressure of the carbon dioxide, and the critical pressure of the carbon dioxide is 74 Kg/cm2.

10. The carbon dioxide refrigeration system according to claim 1, wherein a first static pressure chamber is formed between the negative-pressure fan and the heat exchange device, a second static pressure chamber is formed between the liquid atomization device and the heat exchange device, the negative-pressure fan is configured to form a negative-pressure environment in the second static pressure chamber, and the liquid atomization device is configured to spray the atomized liquid into the second static pressure chamber to evaporate the atomized liquid into vapor.

11. The carbon dioxide refrigeration system according to claim 1, wherein the flash-evaporation condenser comprises a pressure regulating device, a gas inlet of the pressure regulating device is arranged outside the housing, an air outlet of the pressure regulating device is arranged inside the housing, a regulating air flow is sent into the housing by means of the pressure regulating device to promote flow of the vapor in the housing and form an aerosol in the housing; or the pressure regulating device is one or more fans, and the one or more fans are arranged close to the liquid atomization device; or the pressure regulating device is a negative-pressure fan connected to the housing through a vapor circulation pipeline.

12. The carbon dioxide refrigeration system according to claim 1, wherein the refrigeration system comprises a four-way reversing valve, wherein the four-way reversing valve comprises a valve body; a first outlet, a second outlet, a third outlet and a fourth outlet are defined on the valve body, a gas passage is defined inside the valve body, the gas passage is configured to communicate the first outlet, the second outlet, the third outlet and the fourth outlet; a first valve core assembly and a second valve core assembly are provided in the valve body, and the first valve core assembly and the second valve core assembly are movable inside the valve body to switch a communication relationship between the outlets; and the first valve core assembly and the second valve core assembly are moved by a pressure generated by a high-pressure power gas source.

13. The carbon dioxide refrigeration system according to claim 12, wherein each of the first valve core assembly and the second valve core assembly comprises a spring, two valve cores, a screw rod, a valve tube and a shaft sleeve, wherein two ends of the screw rod are respectively connected to the two valve cores, one end of the spring is connected to one of the two valve cores, and another end of the spring is connected to a spring fixing base, the valve tube is sleeved on the screw rod, a side of the valve tube facing the outlet has an open structure, the open structure allows gas to enter an interior of the four-way reversing valve, the shaft sleeve is arranged on the valve core, and the shaft sleeve cooperates with the valve tube to prevent carbon dioxide gas from passing through.

14. The carbon dioxide refrigeration system according to claim 1, wherein the carbon dioxide refrigeration system comprises a first four-way reversing valve, a second four-way reversing valve and a third four-way reversing valve;

wherein four outlets of the first four-way reversing valve are respectively connected to an inlet of the condenser, an inlet of the compressor, an outlet of the compressor and an outlet of the evaporator through a gas pipeline; two outlets of the second four-way reversing valve are respectively connected to an outlet of the condenser and an inlet of the gas-liquid separator through the gas pipeline, and the other two outlets of the second four-way reversing valve are respectively connected to two outlets of the third four-way reversing valve;

two outlets of the third four-way reversing valve are respectively connected to an outlet of the liquid reservoir and an inlet of the evaporator, and the other two outlet of the third four-way reversing valve are respectively connected to the other two outlets of the second four-way reversing valve.

15. The carbon dioxide refrigeration system according to claim 14, wherein in a refrigeration mode, the first four-way reversing valve communicates the outlet of the compressor with the inlet of the condenser, and communicates the outlet of the evaporator with the inlet of the compressor;

the second four-way reversing valve communicates the outlet of the condenser with the inlet of the gas-liquid separator, and the other two ports of the second four-way reversing valve communicate with the third four-way reversing valve;

the third four-way reversing valve communicates the outlet of the liquid reservoir with the inlet of the evaporator, and other two outlet of the third four-way reversing valve communicate with the second four-way reversing valve; in a heating mode, the first four-way reversing valve communicates the outlet of the compressor with the evaporator, and communicates the inlet of the condenser with the inlet of the compressor;

the second four-way reversing valve communicates the outlet of the condenser with the third four-way reversing valve, and communicates the third four-way reversing valve with the inlet of the gas-liquid separator;

the third four-way reversing valve communicates the outlet of the liquid reservoir with the second four-way reversing valve, and communicates the evaporator with the second four-way reversing valve.

16. The carbon dioxide refrigeration system according to claim 1, wherein an overflow differential pressure valve is arranged between the condenser and the liquid reservoir, the overflow differential pressure valve comprises a differential pressure valve housing, a sealing gasket, a differential pressure valve inlet and a differential pressure valve outlet, wherein the differential pressure valve inlet is in communication with the differential pressure valve outlet of the condenser, and the differential pressure valve outlet is in communication with the liquid reservoir;

the sealing gasket is arranged in a chamber formed inside the differential pressure valve housing, the differential pressure valve inlet and the differential pressure valve outlet are both in communication with the chamber formed inside the differential pressure valve housing, and the sealing gasket is movable in the differential pressure valve housing according to a pressure change to realize communication or occlusion between the differential pressure valve inlet and the differential pressure valve outlet.

17. The carbon dioxide refrigeration system according to claim 16, wherein the overflow differential pressure valve further comprises a differential pressure valve spring, wherein one end of the differential pressure valve spring is connected to the sealing gasket, another end of the differential pressure valve spring is fixed on the differential pressure valve housing, a shape of the sealing gasket matches a sectional shape of the chamber formed inside the differential pressure valve housing, and the sealing gasket is configured to move back and forth with compression or release of the differential pressure valve spring.

18. The carbon dioxide refrigeration system according to claim 1, wherein the carbon dioxide refrigeration system comprises a low-pressure circulation barrel, wherein a liquid outlet of the low-pressure circulation barrel is in communication with an inlet end of the evaporator, an outlet end of the evaporator is in communication the low-pressure circulation barrel, and a gas outlet of the low-pressure circulation barrel is in communication with the compressor.

19. A refrigeration method using carbon dioxide as a medium, comprising the following steps:

(1), compressing high-pressure carbon dioxide gas in an evaporator into a condenser by a compressor for cooling;

(2), sucking the carbon dioxide gas mixed in carbon dioxide liquid away by a suction assembly to achieve gas-liquid separation; flash-evaporating part of the carbon dioxide liquid by the suction assembly, performing multi-stage cooling to cause the liquid carbon dioxide to be in a super-cooled state; and (3), introducing the super-cooled carbon dioxide liquid into a liquid reservoir for use;

wherein in step (1), the carbon dioxide gas is completely condensed and liquefied in a flash-evaporation condenser by a flash-evaporation condensation method, wherein a heat exchange device and a liquid atomization device are arranged in a closed housing, a negative-pressure fan is arranged on the closed housing, a liquid is sprayed through the high-pressure liquid atomization device to form an atomized liquid with a large specific surface area, and is dispersed in an accommodating chamber of the housing; and under the radiant heat generated by the heat exchange device and the negative pressure generated by the negative-pressure fan, small particles of the atomized liquid are dispersed and suspended in a gas medium to form an aerosol, so that water molecules on a surface of the atomized liquid depart from droplet bodies, transform into vapor and take away heat;

in step (2), the multi-stage cooling is realized by providing a plurality of float valves connected in series, the carbon dioxide liquid passes through the plurality of float valves in sequence, the plurality of float valves are respectively connected to the suction assembly, part of the liquid carbon dioxide is gasified under a suction force, so that the remaining liquid carbon dioxide is in the super-cooled state, and a liquid carbon dioxide with a lower temperature is obtained.

20. The carbon dioxide refrigeration system according to claim 1, wherein the heat exchange device is arranged between the negative-pressure fan and the liquid atomization device.

* * * * *